US008146908B2

(12) United States Patent
Terao

(10) Patent No.: US 8,146,908 B2
(45) Date of Patent: Apr. 3, 2012

(54) STAPLING UNIT, SHEET FINISHING APPARATUS, AND STAPLING METHOD

(75) Inventor: Yasunobu Terao, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/849,705

(22) Filed: Aug. 3, 2010

(65) Prior Publication Data

US 2011/0031675 A1 Feb. 10, 2011

Related U.S. Application Data

(60) Provisional application No. 61/231,186, filed on Aug. 4, 2009.

(51) Int. Cl.
*B65H 37/04* (2006.01)

(52) U.S. Cl. ..... 270/58.09; 270/58.08; 227/2; 227/5; 227/6

(58) Field of Classification Search ..... 270/58.08, 270/58.09, 58.1, 58.11, 58.12, 58.13; 227/2, 227/5, 6

See application file for complete search history.

(56) References Cited

U.S. PATENT DOCUMENTS

| | | | | |
|---|---|---|---|---|
| 5,021,837 | A | 6/1991 | Uto et al. | |
| 5,031,890 | A * | 7/1991 | Hosoi et al. | 270/58.09 |
| 5,064,181 | A * | 11/1991 | Hosoi et al. | 270/58.18 |
| 5,112,034 | A | 5/1992 | Uto et al. | |
| 5,382,011 | A * | 1/1995 | Tani | 270/37 |
| 5,508,798 | A * | 4/1996 | Yamada | 399/410 |
| 6,220,592 | B1 | 4/2001 | Watanabe et al. | |
| 6,231,045 | B1 | 5/2001 | Yamada et al. | |
| 6,322,070 | B2 | 11/2001 | Yamada et al. | |
| 6,337,970 | B1 * | 1/2002 | Okamoto et al. | 399/407 |
| 6,416,052 | B2 | 7/2002 | Yamada et al. | |
| 6,631,896 | B2 | 10/2003 | Yamada et al. | |
| 6,851,666 | B2 * | 2/2005 | Nagao et al. | 270/37 |
| 7,300,045 | B2 | 11/2007 | Terao et al. | |
| 7,648,136 | B2 | 1/2010 | Terao et al. | |
| 7,857,182 | B2 * | 12/2010 | Kato et al. | 227/6 |
| 2003/0057626 | A1 * | 3/2003 | Nagao et al. | 270/58.08 |
| 2003/0080487 | A1 * | 5/2003 | Tamura et al. | 270/58.07 |
| 2007/0063411 | A1 | 3/2007 | Hirano | |

FOREIGN PATENT DOCUMENTS

| | | | |
|---|---|---|---|
| JP | 05016569 | A | 1/1993 |
| JP | 06083132 | A | 3/1994 |
| JP | 08217321 | A | 8/1996 |
| JP | 10279160 | A | 10/1998 |
| JP | 10313328 | A | 11/1998 |
| JP | 10316299 | A | 12/1998 |
| JP | 11157724 | A | 6/1999 |
| JP | 2000105703 | A | 4/2000 |
| JP | 2001072321 | A | 3/2001 |

(Continued)

*Primary Examiner* — Patrick Mackey

(74) *Attorney, Agent, or Firm* — Patterson & Sheridan, LLP

(57) ABSTRACT

Certain embodiments provide a stapling unit including a stapler, a processing tray, a stapler moving mechanism, a sensor configured to scan sheets in a sheet width direction, and a controller configured to drive the stapler. The controller measures sheet width of the sheets according to an output of the sensor. The controller calculates a center position between other two sheet edges each orthogonal to a sheet edge where the stapler drives staples into stapling positions. The controller allocates the stapling positions in the two places with reference to the center position. The controller moves the stapler moving mechanism to the stapling positions.

20 Claims, 19 Drawing Sheets

FOREIGN PATENT DOCUMENTS

| | | | |
|---|---|---|---|
| JP | 2001089009 | A | 4/2001 |
| JP | 2001106423 | A | 4/2001 |
| JP | 2001125459 | A | 5/2001 |
| JP | 2001175130 | A | 6/2001 |
| JP | 2001240304 | A | 9/2001 |
| JP | 2001350595 | A | 12/2001 |
| JP | 2002060118 | A | 2/2002 |
| JP | 2002104720 | A | 4/2002 |
| JP | 2003002511 | A | 1/2003 |
| JP | 2003128323 | A | 5/2003 |
| JP | 2004083261 | A | 3/2004 |
| JP | 2004142863 | A | 5/2004 |

* cited by examiner

STAPLING UNIT, SHEET FINISHING APPARATUS, AND STAPLING METHOD

CROSS-REFERENCE TO RELATED APPLICATION

The present application claims priority under 35 U.S.C. 119 to U.S. Provisional Application Ser. No. 61/231,186, entitled PAPER FINISHING APPARATUS HAVING A STAPLE UNIT, to TERAO, filed on Aug. 4, 2009, the entire disclosure of which is incorporated herein by reference.

FIELD

Embodiments described herein relate generally to a stapling unit, a sheet finishing apparatus, and a stapling method.

BACKGROUND

A finisher has a function of driving staples into sheets manually inserted into an apparatus body in addition to a function of driving staples into sheets supplied from an image forming apparatus.

A user manually inserts a bundle of sheets from an opening on a discharge side of the finisher onto a processing tray. The user designates a stapling position with an operation panel and presses a manual stapling key. A controller causes a stapler to operate. The stapler is guided by a rail to move.

The processing tray leads the sheet bundle to the stapler with, among long sides and short sides of the sheets, the long sides set orthogonal to a sheet moving direction on the processing tray. Alternatively, the processing tray leads the sheet bundle to the stapler with the long sides set parallel to the sheet moving direction.

One sheet has four sheet edges in the front and the back with respect to a direction in which the sheet moves forward and in front and rear. The front and the rear respectively indicate a front side and a rear side of a main body of the finisher. The sheet edges indicate sheet margins spaced away from sheet ends.

The processing tray leads sheets manually inserted by the user to the stapler with the front edge of the sheets faced to the stapler. The stapler drives a staple into any one of three areas of the sheets explained below.

A first area is a place at a front side corner. A second area is a place at a rear side corner. A third area is two places respectively spaced at equal intervals from the center of a sheet edge.

In stapling of the two places in the center of the sheet edge, after the stapler completes the stapling in a first stapling position, the stapler moves to a second stapling position. The stapler drives a staple in the second stapling position.

A stapler moving mechanism needs stapling position information. The stapling position information indicates stapling positions of the two places in the center of the sheet edge. A controller notifies the stapler moving mechanism of position information of a first point on the rear side from the center of the sheet edge and position information of a second point on the front side from the center of the sheet edge.

However, the stapler moving mechanism cannot obtain the stapling position information of the two places in the center of the sheet edge of the sheets manually inserted by the user.

The stapler cannot staple stapling positions of a pair of two places in the center of a sheet edge of sheets, a sheet size of which is unknown.

The sheet size is standard or nonstandard. Positions at a front side sheet end and a rear side sheet end are not fixed for the stapler.

A sheet edge facing the stapler is a sheet long side or a sheet short side. The positions at the front side sheet end and the rear side sheet end are not fixed for the stapler.

A position of a front side sheet end of inserted sheets is different in each operation for inserting the sheets. On the processing tray, the user is likely to place a sheet bundle in any place in a moving direction of the stapler. The positions at the front side sheet end and the rear side sheet end are not fixed for the stapler.

DETAILED DESCRIPTION

Figure 1:
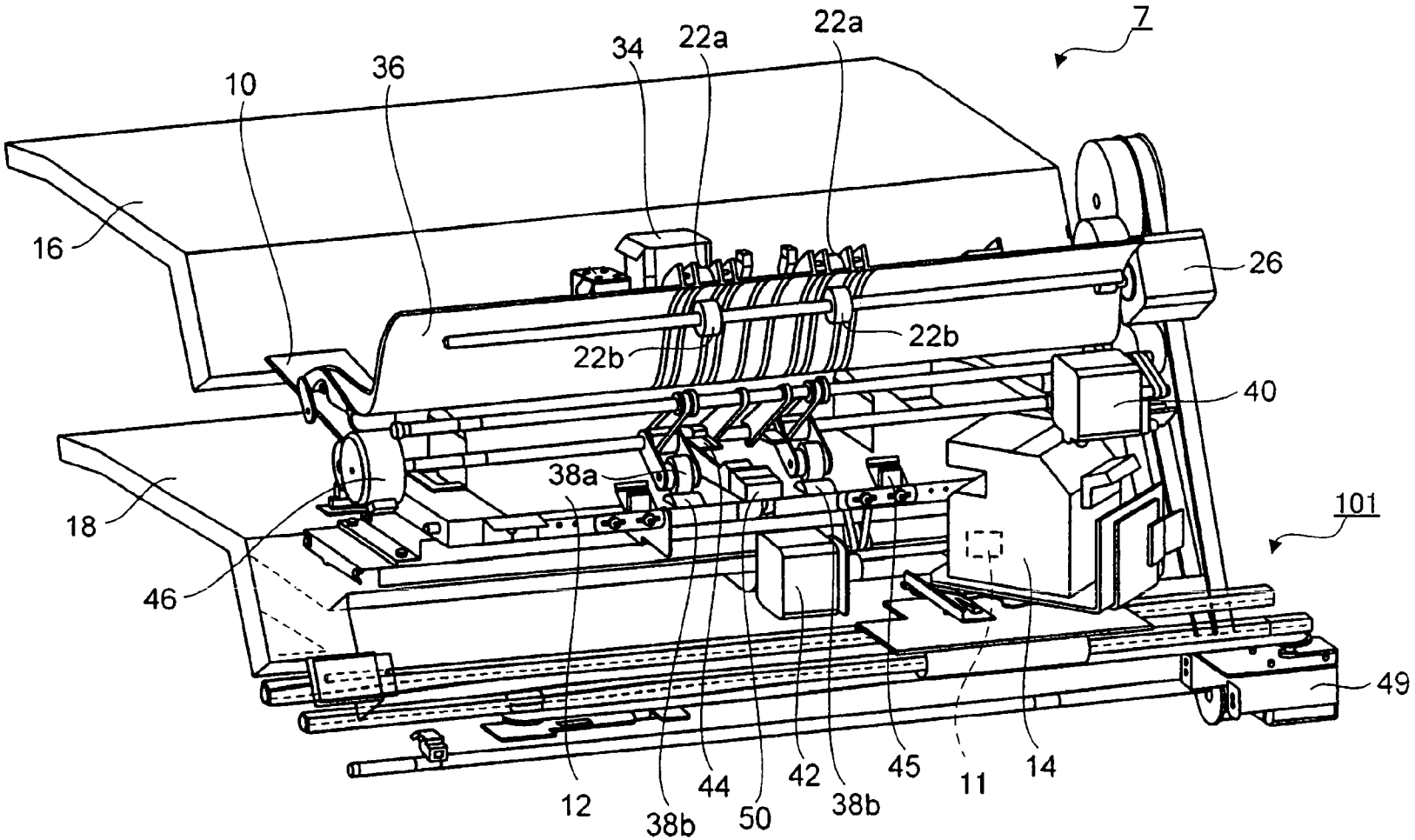
FIG. 1 is a perspective view of an upper part of a sheet finishing apparatus.

Certain embodiments provide a stapling unit including: a stapler configured to drive staples into sheets respectively in stapling positions in two places spaced apart from each other near the center of a sheet edge in a sheet supply direction; a processing tray configured to supply the sheets manually inserted to the stapler, a bundle of the sheets stapled by the stapler being placed on the processing tray; a stapler moving mechanism configured to move the stapler in a sheet width direction orthogonal to a direction of the sheet supply; a sensor configured to scan the sheets in the sheet width direction; and a controller configured to measure sheet width of the sheets according to an output of the sensor, calculate a center position between other two sheet ends each orthogonal to the sheet edge, allocate the stapling positions in the two places with reference to the center position, move the stapler moving mechanism to the stapling positions, and drive the stapler.

A stapling unit, a sheet finishing apparatus, and a stapling method are explained in detail below with reference to the accompanying drawings as examples. In the figures, the same components are denoted by the same reference numerals and signs and redundant explanation of the components is omitted.

First Embodiment

A stapling unit according to a first embodiment is an apparatus configured to move one stapler and drive staples into sheets.

The stapling unit obliquely staples positions at corners in two places of the sheets and staples, in parallel, positions in two places in the center of a sheet edge between the corners. "Parallel" indicates that the staples are driven in a direction parallel to the sheet edge.

The stapling unit realizes parallel stapling of two places in the center of a sheet edge of a sheet bundle manually inserted by a user.

The stapling unit measures sheet width and allocates stapling positions to the two places in the center of the sheet edge. The stapling unit causes the stapler to drive the staples into the sheet bundle.

A sensor moves to detect sheet ends on both sides and measure the sheet width.

The stapling unit includes the sensor.

Figure 2:
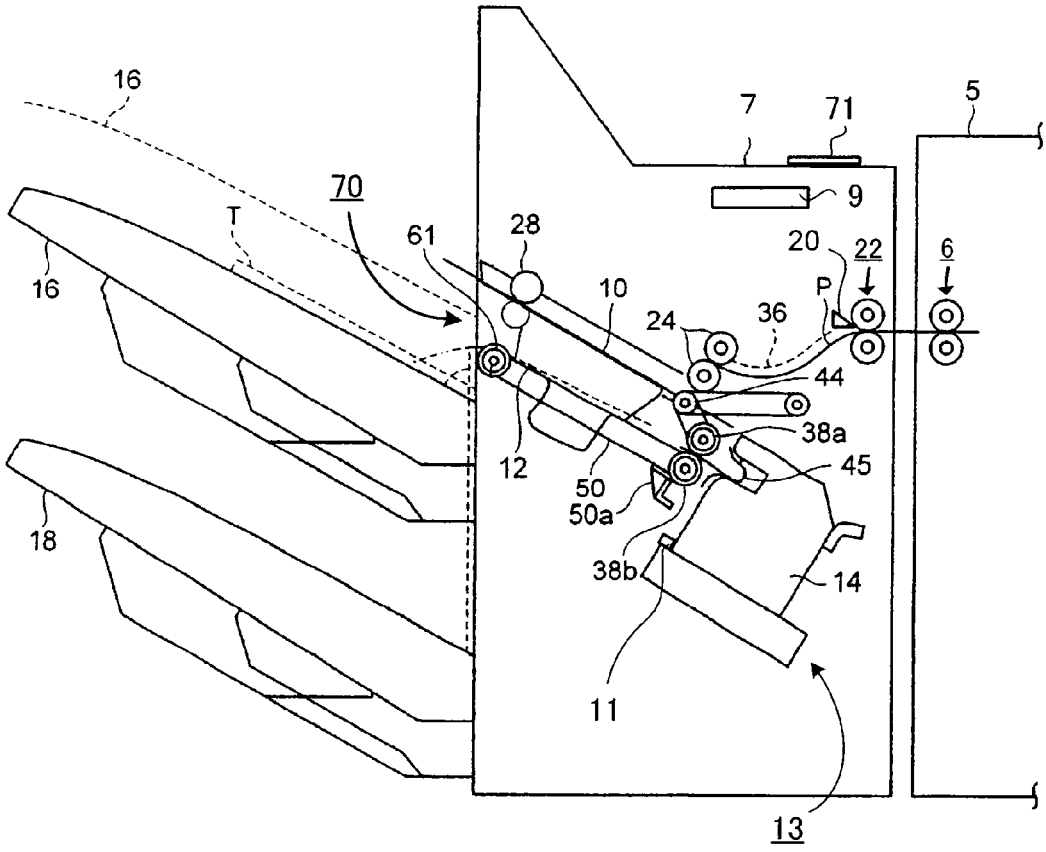
FIG. 2 is a schematic diagram of the sheet finishing apparatus.
Figure 3:
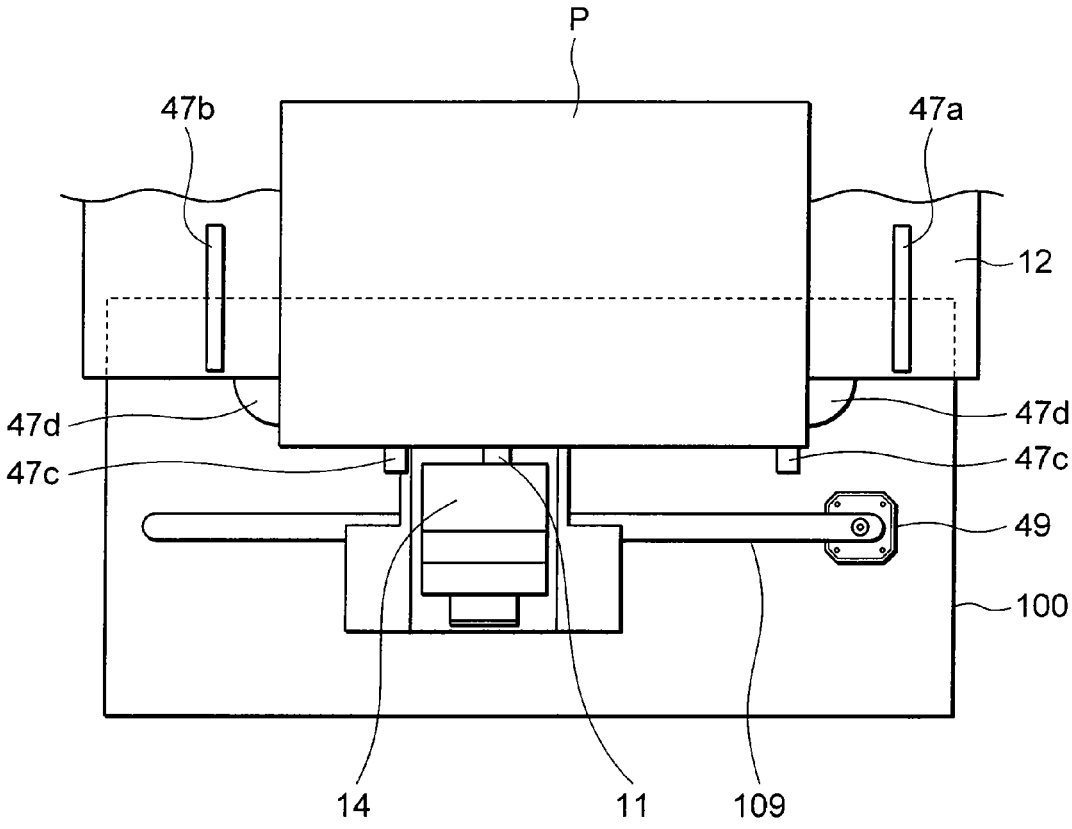
FIG. 3 is a diagram for explaining a method of detecting a sheet end.
Figure 4:
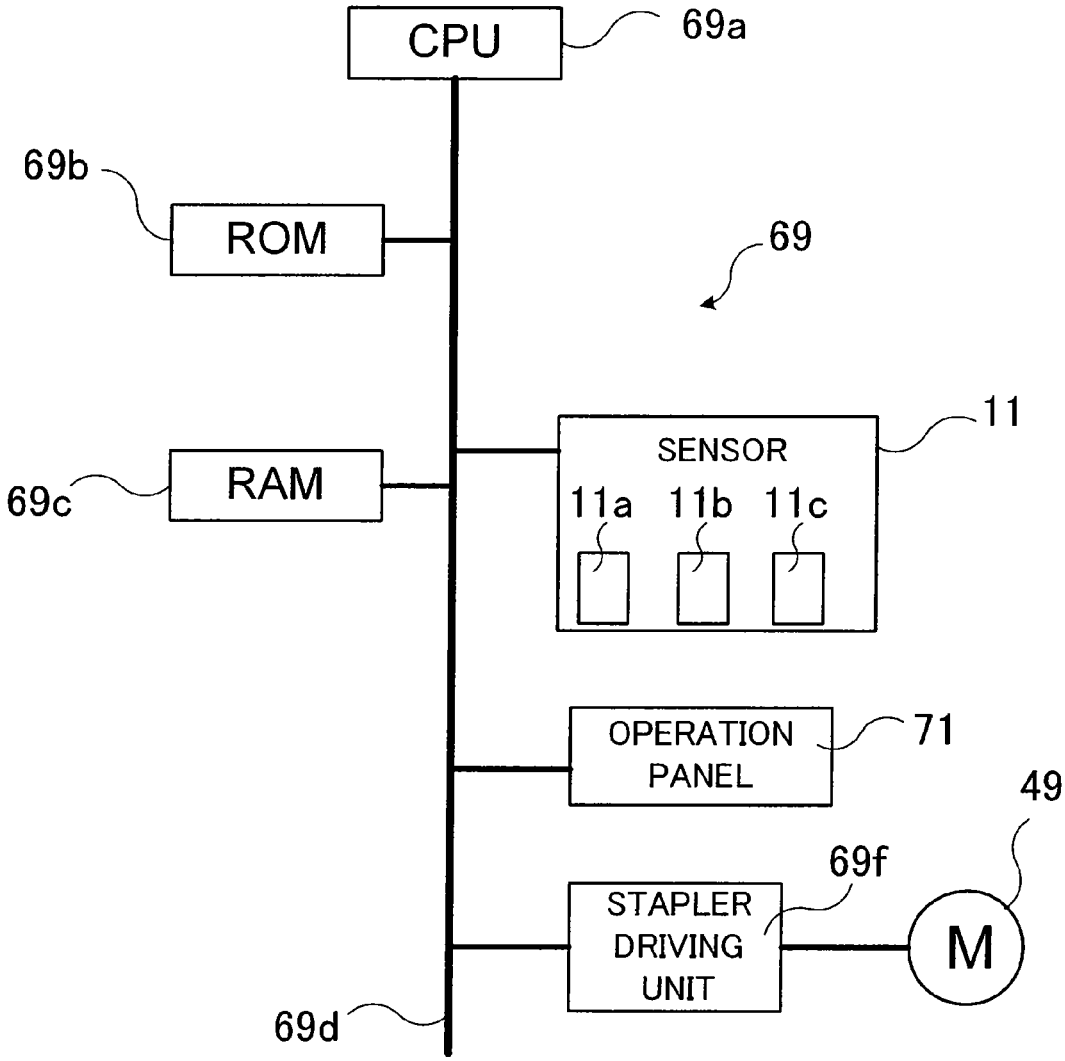
FIG. 4 is a block diagram of a control system for a stapling unit.

FIG. 1 is a perspective view of an upper part of a finisher. FIG. 2 is a schematic diagram of the finisher. FIG. 3 is a diagram for explaining a method of detecting a sheet end. In FIG. 3, the bottom indicates a front end of sheets to be stapled, the left indicates a front side sheet end, and the right indicates a rear side sheet end. FIG. 4 is a block diagram of a controller. A direction from the front to the rear is a depth direction of a finisher main body.

A finisher 7 is a sheet finishing apparatus according to the first embodiment.

The finisher 7 staples a bundle of sheets manually inserted by the user. The finisher 7 staples a bundle of sheets print-output from an image forming apparatus 5 such as a MFP (Multi Function Peripheral) or a copy machine.

The finisher 7 includes a stapler 14, a controller 9, a waiting tray 10, a processing tray 12, a first paper discharge tray 16, a second paper discharge tray 18, and a mechanism 101.

The stapler 14 includes a sensor 11. The sensor 11 moves in a sheet width direction orthogonal to a sheet moving direction. The sensor 11 scans sheets. The sensor 11 detects a position of the front side sheet end and a position of the rear side sheet end. The position of the front side sheet end and the position of the rear side sheet end are parallel to the sheet moving direction.

The controller 9 controls the entire finisher 7. The controller 9 detects the center of a sheet edge. The controller 9 calculates stapling positions in two places. The controller 9 notifies a motor 49, which drives the stapler 14, of stapling position information.

A stepping motor is used as the motor 49. The stapling position information indicates the number of rotation steps of the stepping motor.

The finisher 7 includes a control system 69 configured to control the stapler 14.

The control system 69 includes, for example, as shown in FIG. 4, a CPU (Central Processing Unit) 69*a*, a ROM (Read Only Memory) 69*b*, a RAM (Random Access Memory) 69*c*, and a bus line 69*d*.

The controller 9 includes the CPU 69*a*, the ROM 69*b*, the RAM 69*c*, and the bus line 69*d*. The CPU 69*a* or the like causes a computer program for control to run.

The control system 69 includes the sensor 11, an operation panel 71, and a stapler driving unit 69*f*.

The sensor 11 includes a light emission diode 11*a* configured to output a light beam, a photodiode 11*b* configured to receive a reflected light beam, and an amplifier 11*c* configured to amplify an output of the photodiode 11*b*.

The CPU 69*a* compares an output of the amplifier 11*c* and a threshold of reflected light intensity stored in the ROM 69*b* and detects positions of the front side sheet end and the rear side sheet end.

The operation panel 71 is a user interface on the upper surface of the finisher 7. The operation panel 71 includes keys for user command input and an LED (Light Emitting Diode) for display. The operation panel 71 transmits and receives control signals to and from the controller 9.

The stapler driving unit 69*f* is a motor driver. An IC (Integrated Circuit) or an LSI (Large Scale Integration) is used for the stapler driving unit 69*f*.

The stapler driving unit 69*f* outputs normal and reverse rotation information to the motor 49. The motor 49 outputs the number of rotation steps equivalent to a distance between the present position of the stapler 14 and a stapling position.

The finisher 7 includes an inlet roller pair 22 in a sheet inlet. The inlet roller pair 22 includes an upper roller 22*a* and a lower roller 22*b*. The image forming apparatus 5 outputs a sheet from a paper discharge roller pair 6. A motor 26 rotates the inlet roller pair 22.

If the finisher 7 does not execute finishing on sheets, a branching member 20 closes a lower path. The finisher 7 discharges the sheets to above the finisher main body.

If the finisher 7 executes the finishing on the sheets, the branching member 20 closes an upper path. A pair of paper feeding roller pair 24 feeds the sheets to the waiting tray 10.

The finisher 7 includes a sheet guide 36 between the inlet roller pair 22 and the waiting tray 10. The sheet guide 36 leads the sheets to the paper feeding roller pair 24.

The waiting tray 10 includes a pair of flat tray plates. The pair of tray plates move close to each other and move away from each other. The waiting tray 10 has a structure in which the tray plates move to the left and right with respect to the sheet moving direction.

The waiting tray 10 closes the tray plates and collects sheets. The waiting tray 10 accumulates plural sheets making use of the inclination of plate surfaces of the tray plates. The waiting tray 10 has a structure for clamping the trailing end of a sheet bundle. The waiting tray 10 accumulates the sheet bundle on a tray surface.

The finisher 7 includes the processing tray 12 below the waiting tray 10. The processing tray 12 includes alignment plates 47*a* and 47*b* and a guide 47*c* for sheet insertion.

The waiting tray 10 opens the pair of tray plates according to driving of a motor 34 by the controller 9. The waiting tray 10 drops the sheet bundle onto the processing tray 12 with the own weight of the sheet bundle.

The sheets dropped from the waiting tray 10 are stacked on the processing tray 12. While the stapler 14 is stapling the sheet bundle, the processing tray 12 clamps the trailing end of the sheet bundle and aligns the sheet bundle.

The controller 9 detects that the user manually inserts sheets. The processing tray 12 holds the sheets inserted from an opening 70.

Figure 5A:
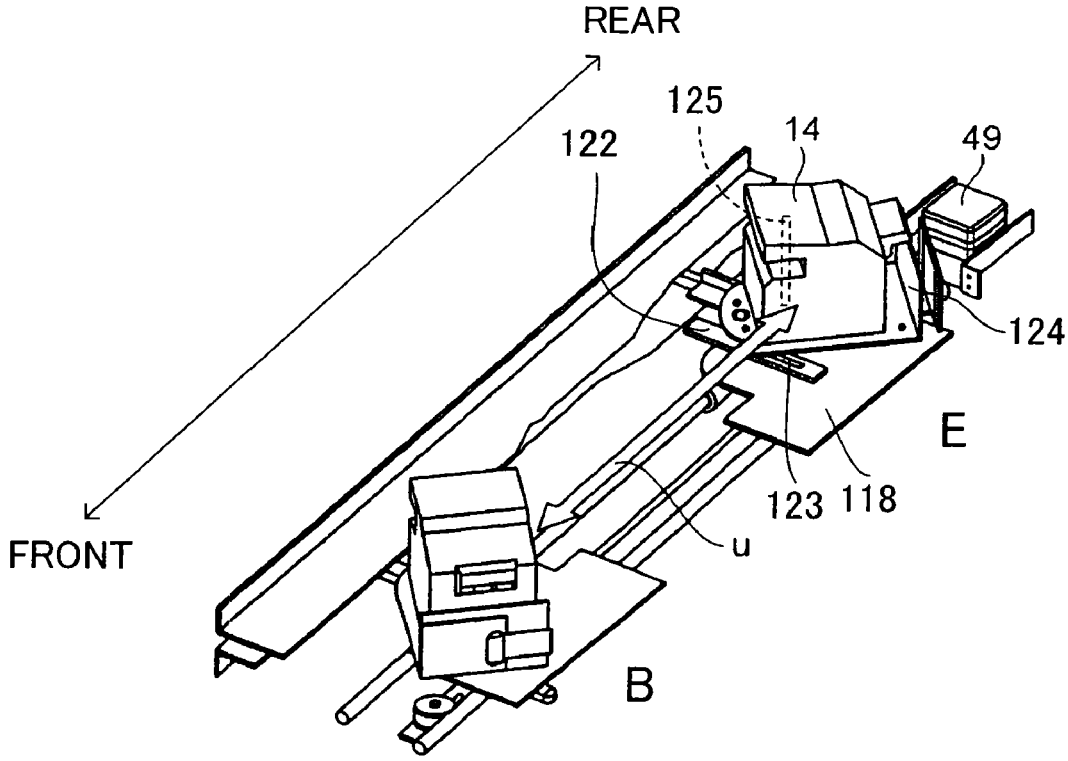
FIG. 5A is a perspective view of the back of a stapler.

FIG. 5A is a perspective view of the back of the stapler 14. In FIG. 5A, the stapler 14 without a cover is shown. "u" indicates a stapler moving direction. A distance between positions B and E along the u direction is a moving stroke amount of the stapler 14.

The controller 9 and the stapler driving unit 69*f* control the motor 49.

Figure 5B:
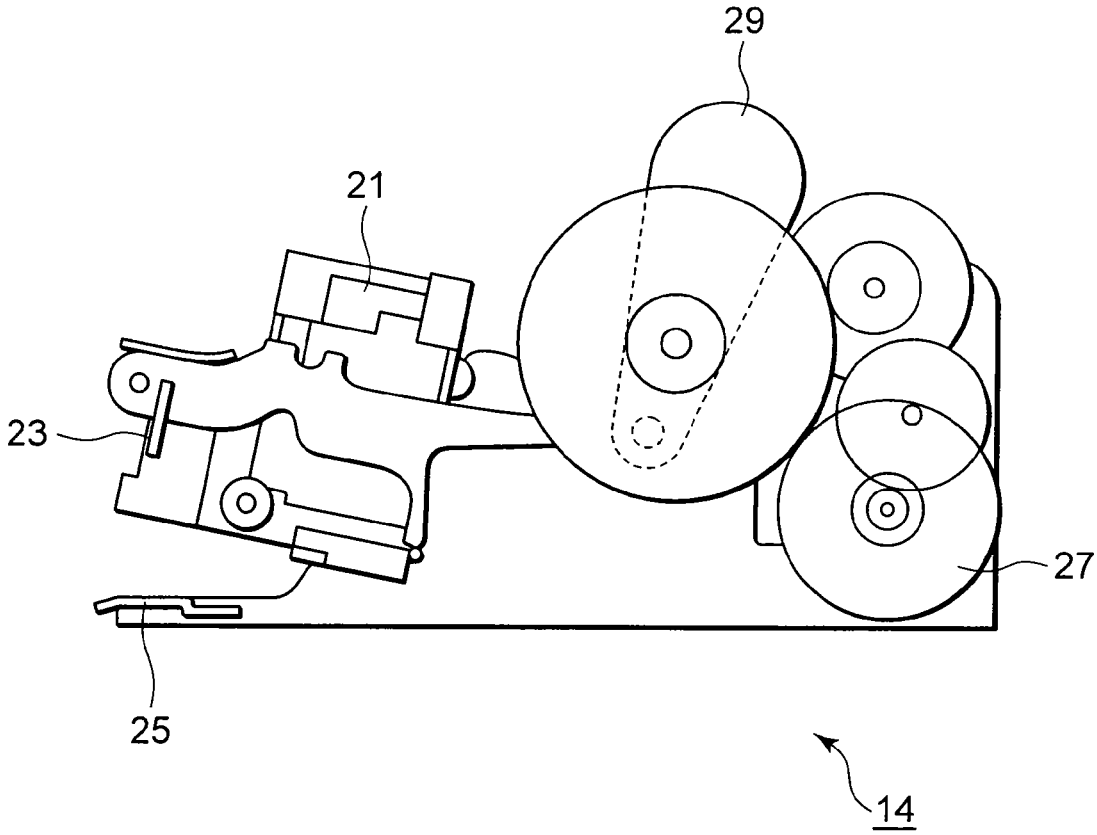
FIG. 5B is a side view of an example of a head of the stapler.

FIG. 5B is a side view of an example of a head of the stapler 14. The stapler 14 includes a cartridge 21, a plate 23, an anvil 25, a stapling motor 27, and a cam 29. The plate 23 pushes out staples.

The controller 9 rotates the stapling motor 27. The cam 29 rotates to cause force to act on the plate 23.

A mechanism for moving the stapler 14 is explained with reference to FIGS. 5A and 6A to 6C.

Figure 6A:
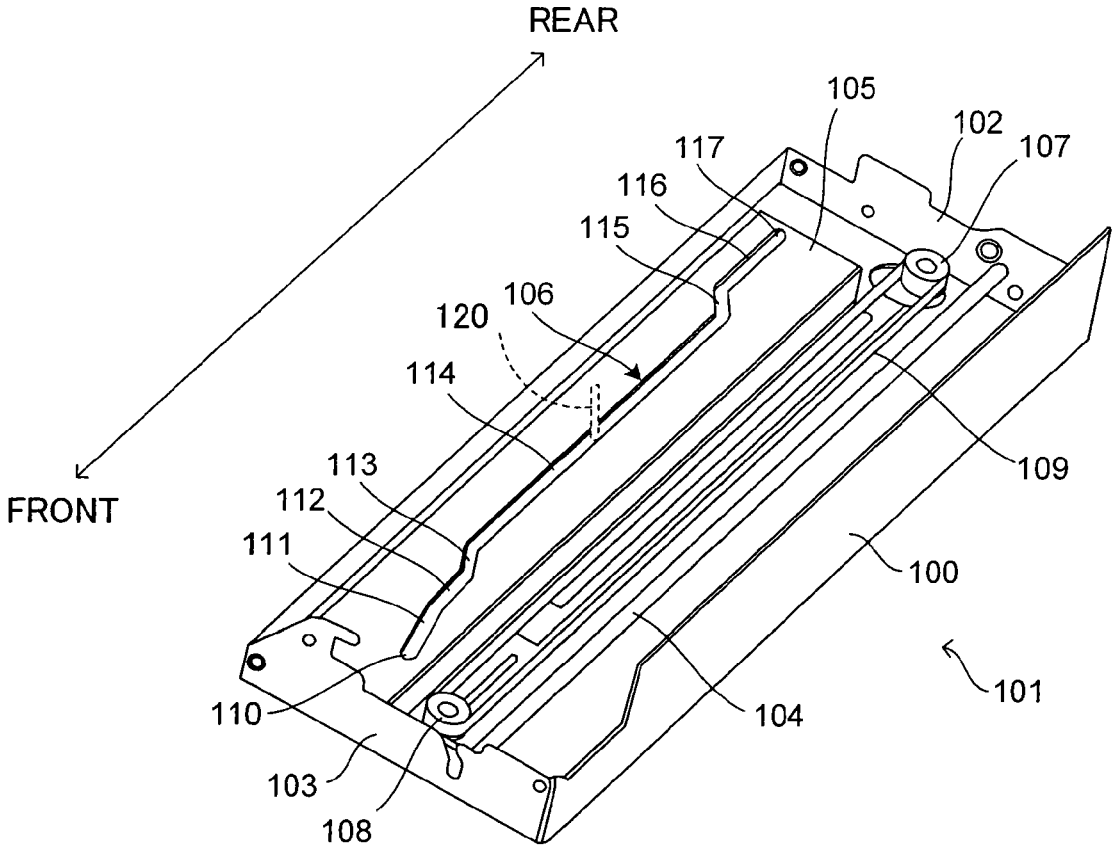
FIG. 6A is a perspective view of a frame to which the stapler is attached.
Figure 6B:
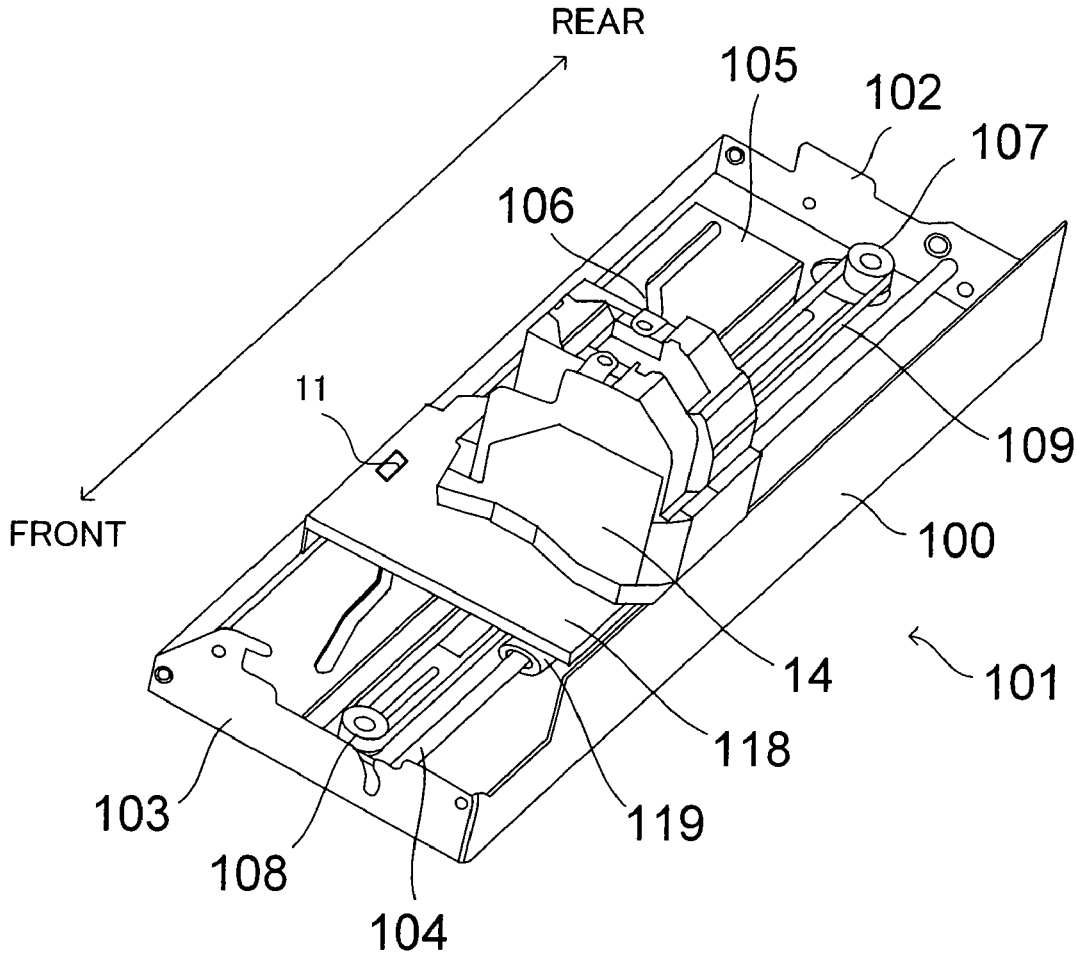
FIG. 6B is a perspective view of a stapler moving mechanism.

FIG. 6A is a perspective view of a frame to which the stapler 14 is attached. FIG. 6B is a perspective view of a stapler moving mechanism. The reference numerals described above denote the same components. The lower left in FIGS. 6A and 6B indicates the front side of the finisher 7. The upper right indicates the rear side of the finisher 7.

The mechanism 101 is a stapler moving mechanism configured to move the stapler 14. The mechanism 101 includes a frame 100.

The frame 100 includes walls 102 and 103 opposed to each other. The mechanism 101 includes a rail 104 between the walls 102 and 103.

The mechanism 101 includes a table 105 having a side parallel to the rail 104. The table 105 has a groove-like slit 106.

The mechanism 101 includes two pulleys 107 and 108 on the bottom surface of the frame 100. The pulleys 107 and 108 are axially supported on the bottom surface.

Torque is transmitted to the pulley 107 on the rear side from the motor 49. The pulley 108 on the front side is a driven pulley. A belt 109 is wound around the pulleys 107 and 108. The belt 109 is an endless belt.

The table 105 is located on the opposite side of the rail 104 across the belt 109. The table 105 is a platform for the stapler 14. The slit 106 is formed on the table 105.

The stapler 14 is guided through the slit 106 by a pin 102 provided below the stapler head. The stapler 14 is moved to the front side and the rear side above the table 105 via the slit 106.

The slit 106 has plural sub-combinations.

Figure 6C:
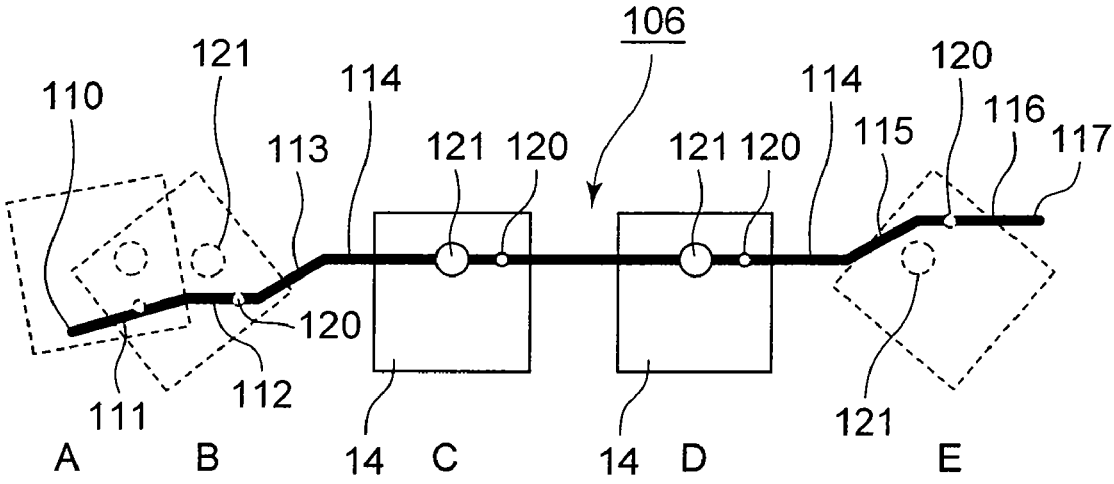
FIG. 6C is a top view of a slit.

FIG. 6C is a top view of the slit 106. The reference numerals described above denote the same components.

Starting from an end 110 on the front side of the slit 106, a tilt 111, a parallel 112, a tilt 113, a parallel 114, a tilt 115, a parallel 116, and an end 117 define one guide groove.

The size of a crossing angle between the tilt 113 and the parallel 114 is 30 degrees. The size of a crossing angle between the tilt 115 and the parallel 114 is 30 degrees. The size of a crossing angle between the tilt 115 and the parallel 116 is also 30 degrees.

As shown in FIGS. 5 and 6B, the mechanism 101 includes a plate 118 below the stapler 14. The lower surface of the plate 118 comes into contact with a half pipe 119 and moves. The plate 118 moves above the half pipe 119 along the rail 104.

The pulley 107 normally and reversely rotates. The belt 109 rotates in first and second directions. The plate 118 moves in the first direction and the second direction opposite to the first direction. The plate 118 always takes a fixed posture.

The root of the pin 120 is closer to the left in FIG. 6B. The tip of the pin 120 is kept fit in the slit 106. The tip of the pin 120 comes into contact with the bottom surface of the slit 106 and moves.

The mechanism 101 has a structure in which the stapler 14 moves with respect to the plate 118. For example, the mechanism 101 includes the plate 118, an arm 122 fixed on the plate 118, and a hole 123 provided in the arm 122.

Further, the mechanism 101 includes a bearing guided by the hole 123, a supporting member 124 above the plate 118, and a stud 125 fixed to the supporting member 124. The bearing rolls. The supporting member 124 moves above the plate 118.

The stapler 14 is provided on the supporting member 124. The lower end of the stud 125 is fixed to the upper surface of the plate 118. The supporting member 124 pivots with respect to the side of the stud 125.

The stapler 14 pivots above the plate 118 with the stud 125 as a pivot center. Reference numeral 121 in FIG. 6C denotes the pivot center. A distance between the pivot center 121 and the pin 120 is always fixed.

When the plate 118 moves, the pin 120 in the parallel 114 moves to the tilt 115. The stapler 14 pivots above the plate 118 with the distance between the pivot center 121 and the pin 120 as a pivoting radius and with the pivoting center 121 as the center.

The posture of the stapler 14 tilts at both ends of the moving stroke.

A position A is a position for replacement of the stapler 14. In the position A, the stapler 14 is on the outside of the frame 100. The position A is further on the outer side than the position B in a stroke direction. The sensor 11 is provided in the stapler main body on the opposite side of the position A for replacement of the stapler 14. The sensor 11 is located in a far side away from the position A with respect to the center of the width of the stapler main body.

In positions B and E, the stapler 14 staples a sheet bundle at tilts. The controller 9 stores one of the positions B and E in the ROM 69*b* as a home position of the stapler 14.

In positions C and D, the stapler 14 staples the sheet bundle. A line connecting the positions C and D is parallel to a sheet edge. The positions C and D are respectively located at equal intervals from the center of the sheet edge.

The above is the explanation of the stapler 14.

The processing tray 12 supplies a sheet bundle to the stapler 14.

The processing tray 12 receives, from the waiting tray 10, the sheet bundle before being stapled. The processing tray 12 grasps the sheet bundle being stapled. The processing tray 12 conveys, to the first paper discharge tray 16, the sheet bundle after being stapled.

The processing tray 12 aligns sheets falling from the waiting tray 10 or a sheet bundle inserted from the opening 70. The processing tray 12 aligns the sheets in the moving direction, the front side direction, and the rear side direction.

The processing tray 12 includes two alignment roller pairs 38. The alignment roller pairs 38 align the sheets in the moving direction.

Figure 7:
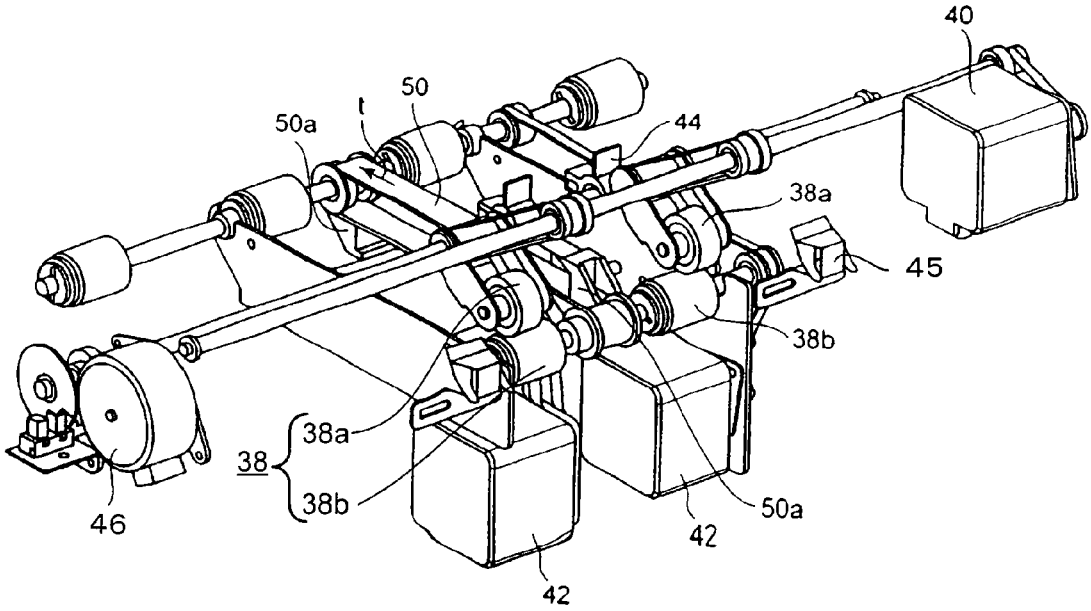
FIG. 7 is a perspective view of an alignment roller pair.

FIG. 7 is a perspective view of the alignment roller pairs 38. The reference numerals and signs already described denote the same components. The alignment roller pairs 38 include upper rollers 38*a* and lower rollers 38*b*.

The upper rollers 38*a* and the lower rollers 38*b* nip a sheet bundle after being stapled. The upper rollers 38*a* and the lower rollers 38*b* extract the sheet bundle with staples from the stapler 14. The upper rollers 38*a* and the lower rollers 38*b* also have a function of bundle conveying roller pairs.

The upper rollers 38*a* are driven by a motor 40. The lower rollers 38*b* are driven by a motor 42.

Figure 8:
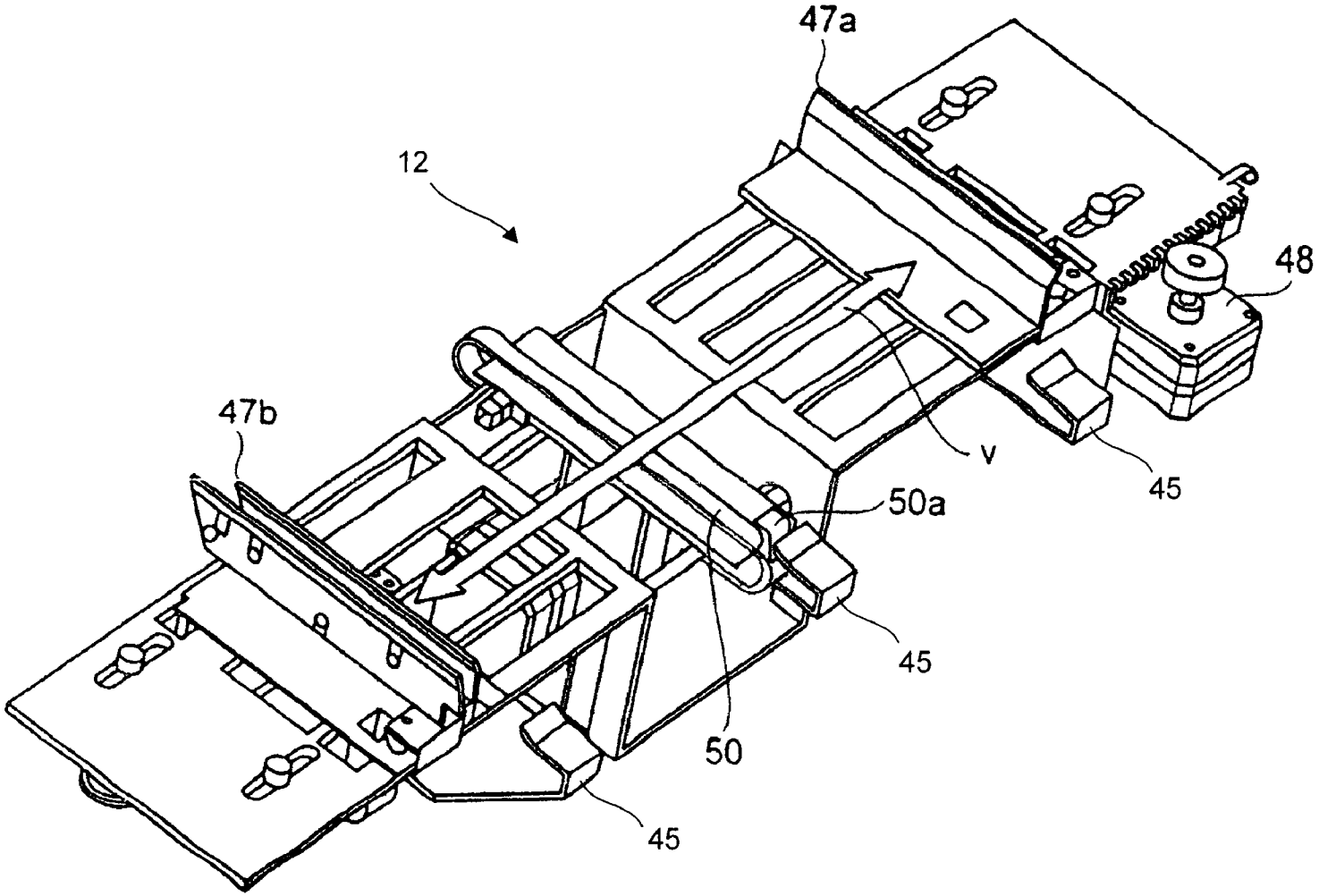
FIG. 8 is a perspective view of alignment plates and a conveyor belt.

FIG. 8 is a perspective view of the alignment plates 47*a* and 47*b* and a conveyor belt. The reference numerals and signs already described denote the same components.

The processing tray 12 includes the alignment plates 47*a* and 47*b*. The alignment plates 47*a* and 47*b* are a pair of fences on the processing tray 12.

The alignment plates 47*a* and 47*b* are slid in a v direction (a depth direction) on the processing tray 12 by a motor 48. The alignment plates 47*a* and 47*b* push sheets in the v direction. The processing tray 12 prevents the sheets from being disarranged in the v direction orthogonal to the conveying direction.

The alignment plates 47*a* and 47*b* suppress disarrangement of a sheet bundle due to a fall from the waiting tray 10 to the processing tray 12.

The finisher 7 includes, in the processing tray 12, a paper discharge roller pair 61 configured to discharge a sheet bundle.

The finisher 7 includes paddles 44 in a position where a sheet end falls onto the processing tray 12.

The paddles 44 align, in a longitudinal direction, a top sheet of a sheet bundle stacked on the processing tray 12. The longitudinal direction indicates the sheet moving direction.

Figure 9:
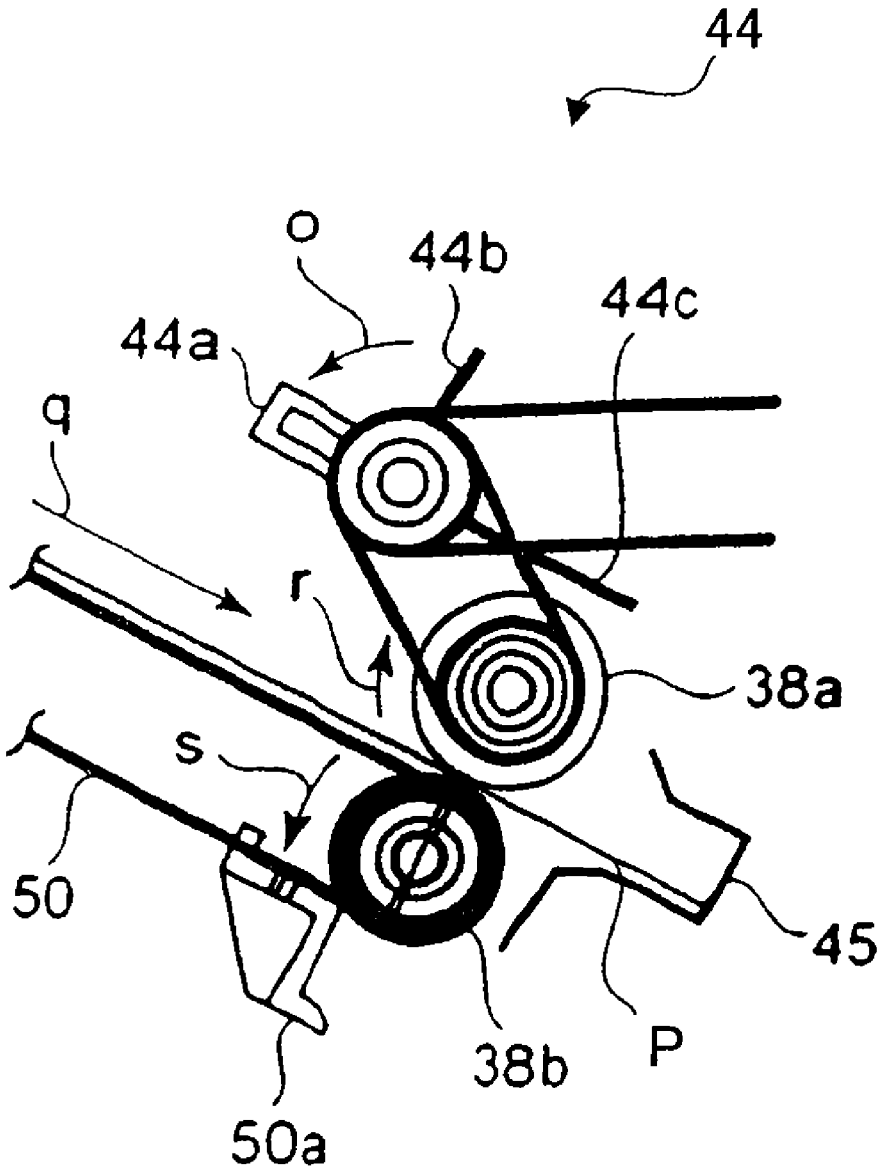
FIG. 9 is a diagram of a paddle viewed from a side in a paddle axis direction.

FIG. 9 is a diagram of the paddles 44 viewed from a side in a paddle axis direction. The reference numerals and signs already described denote the same components. Each of the paddles 44 includes paddle pieces 44*a*, 44*b*, and 44*c* driven the by a paddle motor 46.

The paddle piece 44*a* comes into contact with sheets arriving from the waiting tray 10. The paddle piece 44*b* sends the sheets coming into contact with the paddle piece 44*a* onto the processing tray 12. The paddle piece 44*c* aligns the sheets on the processing tray 12.

The processing tray 12 includes, at an end on the stapler 14 side, stoppers 45 configured to regulate movement of a sheet end. The processing tray 12 includes a conveyor belt 50 in the center in the depth direction.

The upper roller 38*a* and the lower roller 38*b* pull a sheet bundle from the stapler 14. The conveyor belt 50 conveys the sheet bundle pulled in that way. The conveyor belt 50 conveys the sheet bundle to the first paper discharge tray 16 or the second paper discharge tray 18. The conveyor belt 50 has a pawl 50*a* configured to hook the trailing end of the sheet bundle.

The waiting tray 10 conveys sheets to the first paper discharge tray 16 or the second paper discharge tray 18.

The waiting tray 10 includes a waiting tray roller 28 for aligning sheets on the waiting tray 10. The waiting tray 10 brings the waiting tray roller 28 into contact with the sheets on the waiting tray 10 and conveys the sheets in the direction of the paper discharge trays 16 and 18.

The waiting tray roller 28 is rotated by motor driving. The waiting tray roller 28 is moved up and down by the motor driving.

A tray surface of the waiting tray 10 tilts with respect to a horizontal plane. Sheets are placed on the waiting tray 10 such that a sheet leading end in the sheet moving direction is higher than a sheet trailing end.

The first paper discharge tray 16 and the second paper discharge tray 18 are lifted and lowered by motor driving. The controller 9 selects one of the first paper discharge tray 16 and the second paper discharge tray 18.

Tray surfaces of the first paper discharge tray 16 and the second paper discharge tray 18 tilt with respect to the horizontal plane. Sheets are placed on a tray surface of the first paper discharge tray 16 or the second paper discharge tray 18 such that a sheet leading end in the sheet moving direction is higher than a sheet trailing end.

The finisher 7 having the configuration explained above executes, independently from a stapling job for print-out sheets, a stapling job for sheets manually inserted by the user.

The user removes staples from a bundle of plural original documents. The user inserts the bundle of original documents into the image forming apparatus 5. A scanner unit reads the original documents. The image forming apparatus 5 returns the scanned original documents onto the image forming apparatus 5.

The user manually extracts, offline, the bundle of original documents without staples from the image forming apparatus 5. The user manually aligns the bundle of original documents.

Figure 10A:
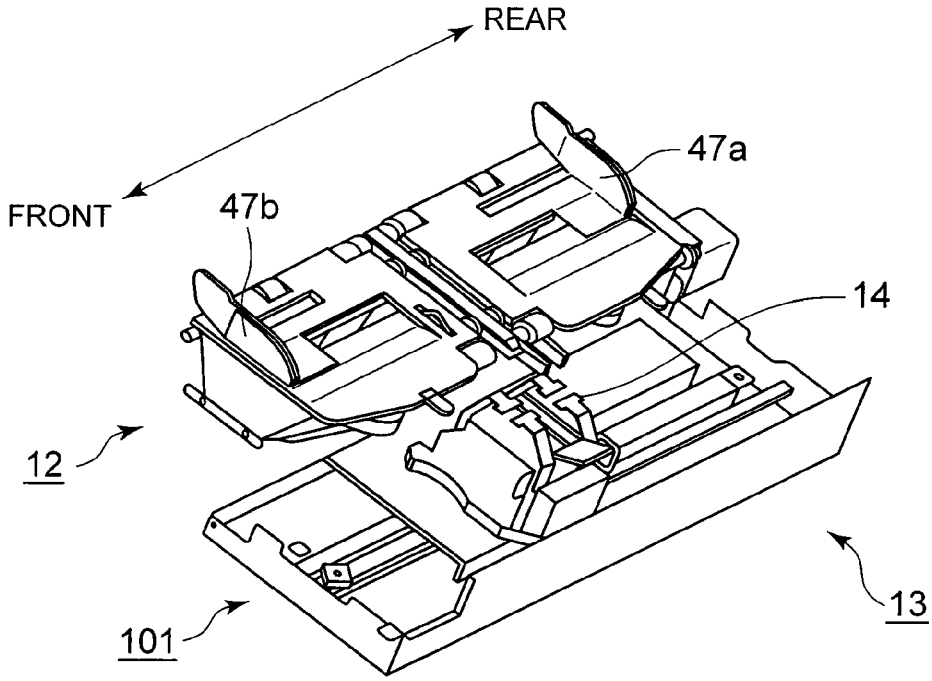
FIG. 10A is a disassembled perspective view of the stapling unit.

FIG. 10A is a disassemble perspective view of the stapling unit. The stapling unit 13 includes the stapler 14, the mechanism 101, and the processing tray 12.

Figure 10B:
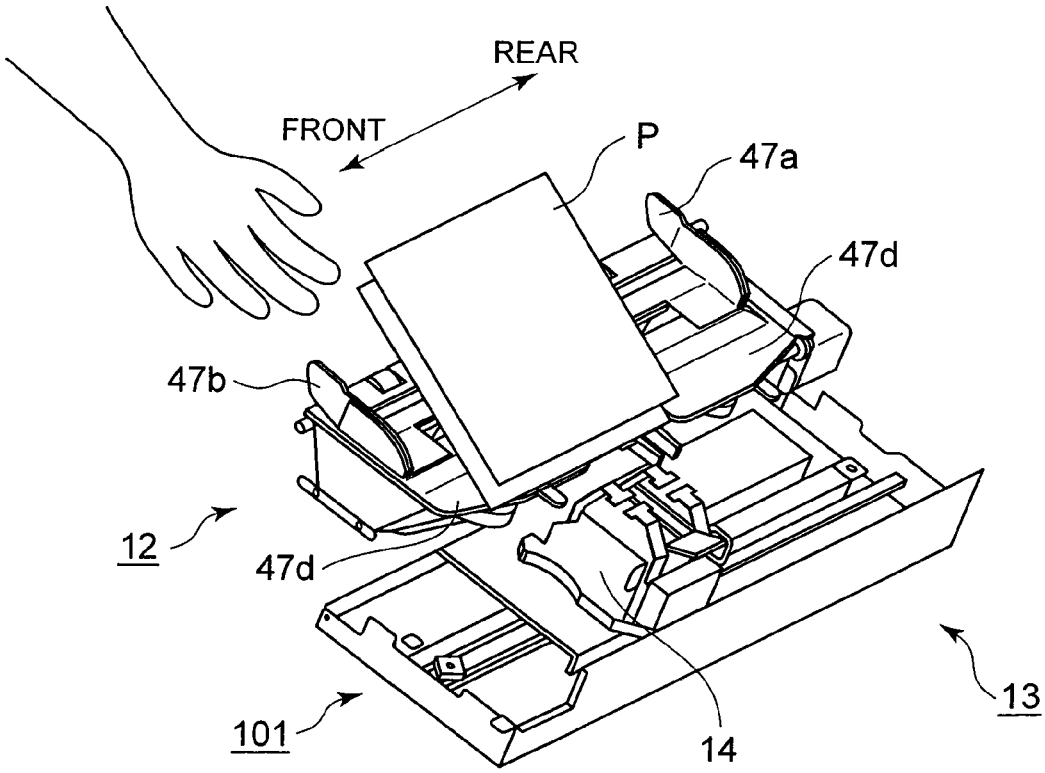
FIG. 10B is a perspective view of the stapling unit in a state in which a user manually inserts sheets.

FIG. 10B is a perspective view of the stapling unit 13 in a state in which the user manually inserts sheets. In FIGS. 10A and 10B, the reference numerals and signs already described denote the same components.

As shown in FIG. 10A, after the finisher 7 discharges an original document received from the image forming apparatus 5, the controller 9 separates the alignment plates 47*a* and 47*b* from each other.

As shown in FIG. 10B, the user inserts an original document bundle P into the stapling unit 13 from the opening 70 of the finisher 7. The original document bundle P is placed on the tray surface while the alignment plates 47*a* and 47*b* are kept opened.

The user determines, on the processing tray 12, a place where the original document bundle P is inserted in the depth direction. The user places the original document bundle P such that a sheet edge of the original document bundle P on the stapler 14 side is parallel to the stapler moving direction.

The processing tray 12 may have a flexible member 47*d* continuously to the tray surface. The flexible member 47*d* may gently bend a sheet bundle. The mechanism 101 may move the stapler 14 along a sheet edge of the sheet bundle projecting from the flexible member 47*d* to the stapler 14 side.

Long sides of the original document bundle P are orthogonal to the stapler moving direction or parallel to the stapler moving direction.

With original documents regarded as sheets, a job of the finisher 7 for stapling the sheets is explained below.

A stapling method according to the first embodiment includes detecting the center of a sheet edge of a sheet bundle placed on the processing tray 12, calculating stapling positions in two places symmetrical to each other with respect to the center of the sheet edge, and notifying the mechanism 101 of information concerning the stapling positions.

The stapling method further includes moving to a first stapling position, driving staples into the sheet bundle, moving to a second stapling position, and driving staples into the sheet bundle.

Figure 11:
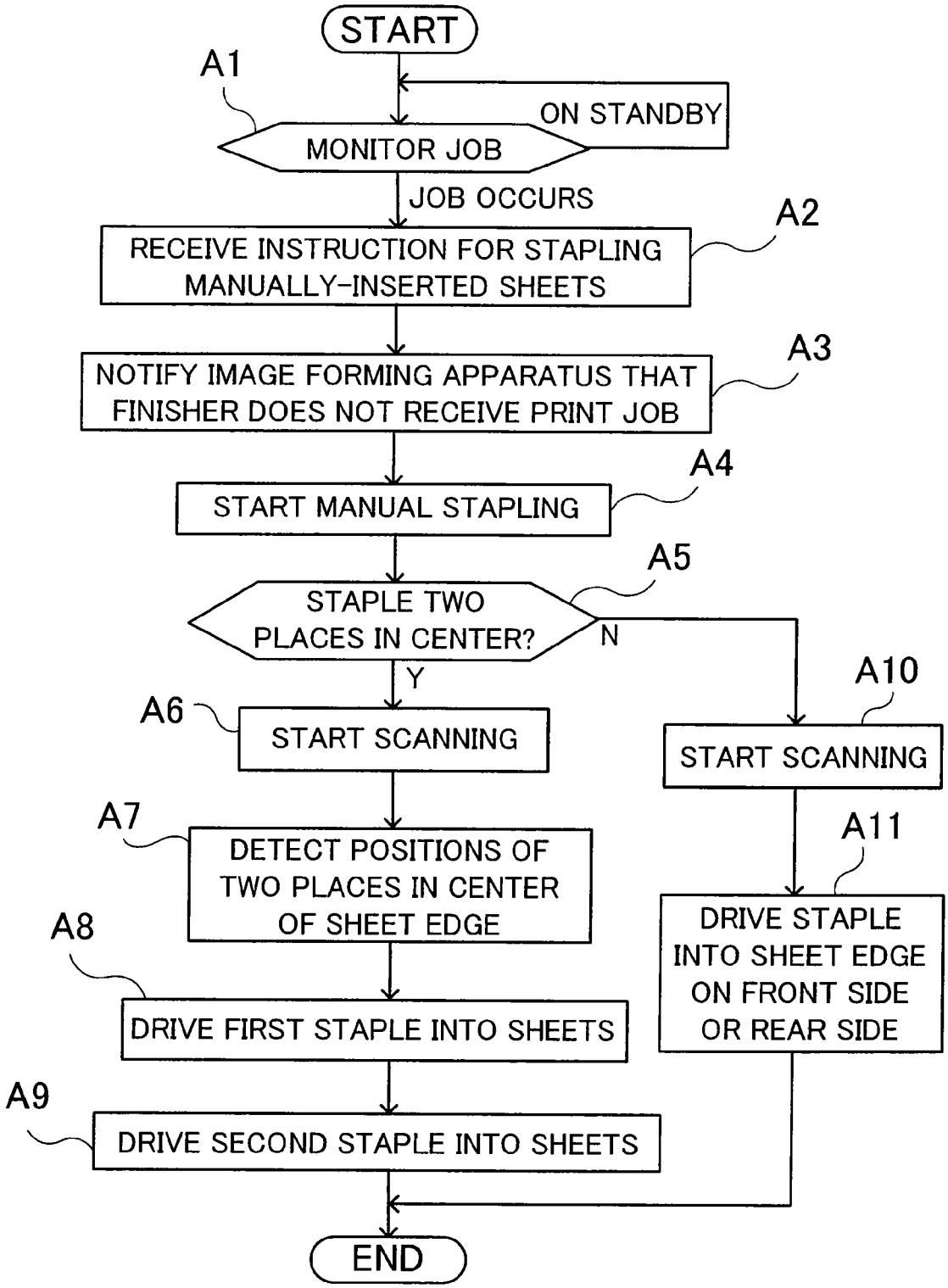
FIG. 11 is a flowchart for explaining a stapling method.

FIG. 11 is a flowchart for explaining the stapling method. In FIG. 11, control of the stapling unit 13 by the controller 9 is shown.

FIGS. 12A to 12F are diagrams of positions of the sensor 11. The top indicates the processing tray 12 side, the left indicates the front side, and the right indicates the rear side. The reference numerals and signs already described denote the same components.

The user operates the operation panel 71.

Figure 13:
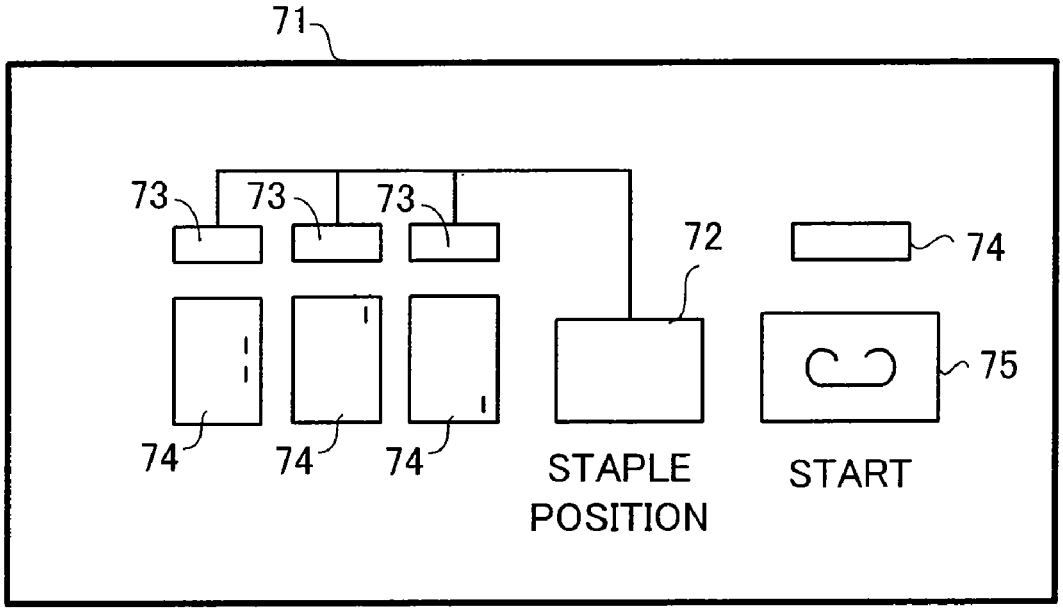
FIG. 13 is a top view of an operation panel.

FIG. 13 is a top view of the operation panel 71. A transmissive film 74 shows "manual stapling".

A touch key 72 selects stapling positions according to user operation. The touch key 72 selects stapling positions in two places in the center of a sheet edge.

The user presses a start key 75. The operation panel 71 sends an instruction for the start of manual stapling and stapling position information to the controller 9.

Figure 12A:
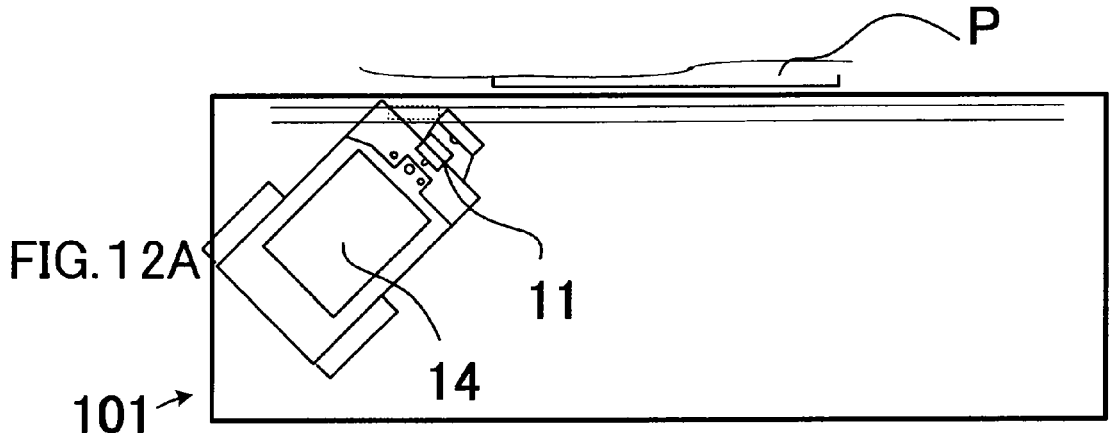
FIGS. 12A to 12F are diagrams of positions of sensors.

In Act A1, the controller 9 monitors occurrence of any one of jobs of finishing. While a job is not input, the controller 9 continues to perform the monitoring while staying on standby. The position of the stapler 14 is the home position as shown in FIG. 12A.

In Act A2, the controller 9 receives an instruction for the start of manual stapling. The controller 9 determines whether there is another finishing job or a print job. The controller 9 determines that the manual stapling is excutable.

In Act A3, the finisher 7 notifies the image forming apparatus 5 that the finisher 7 does not receive the print job. The controller 9 transitions a mode of the finisher 7 to a manual mode. The operation panel 71 causes anyone of LEDs 73 to blink.

As shown in FIG. 10B, the user places plural sheets on the processing tray 12 to be laid one on top of another. The user presses the start key 75.

In Act A4, the controller 9 receives a message of the start of the manual stapling from the operation panel 71. The controller 9 extracts a stapling type from the message.

In Act A5, the controller 9 determines whether the stapling type is stapling of two places in the center of a sheet edge.

If the stapling type is the stapling of two places in the center of a sheet edge in Act A5 (Y in Act A5), in Act A6, the controller 9 starts scanning in the sheet width direction.

Figure 12B:
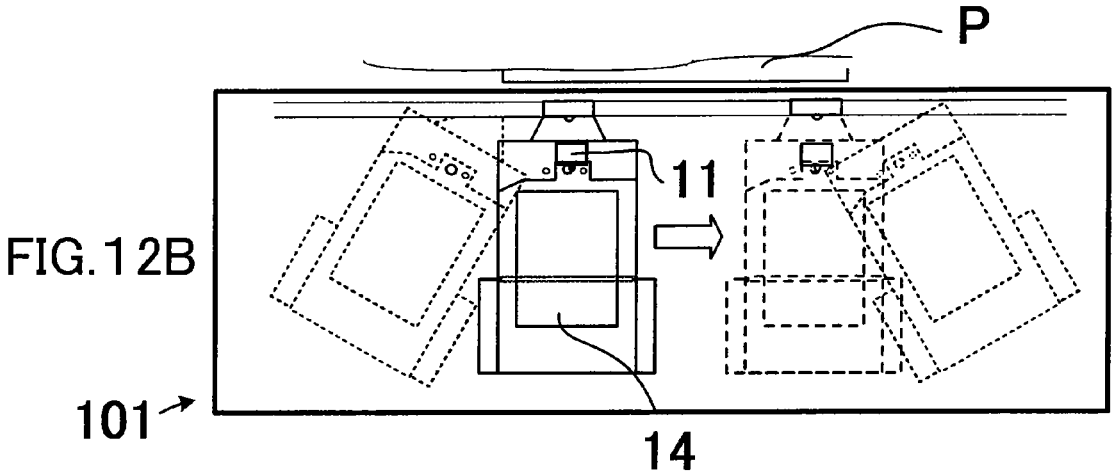
Figure 12C:
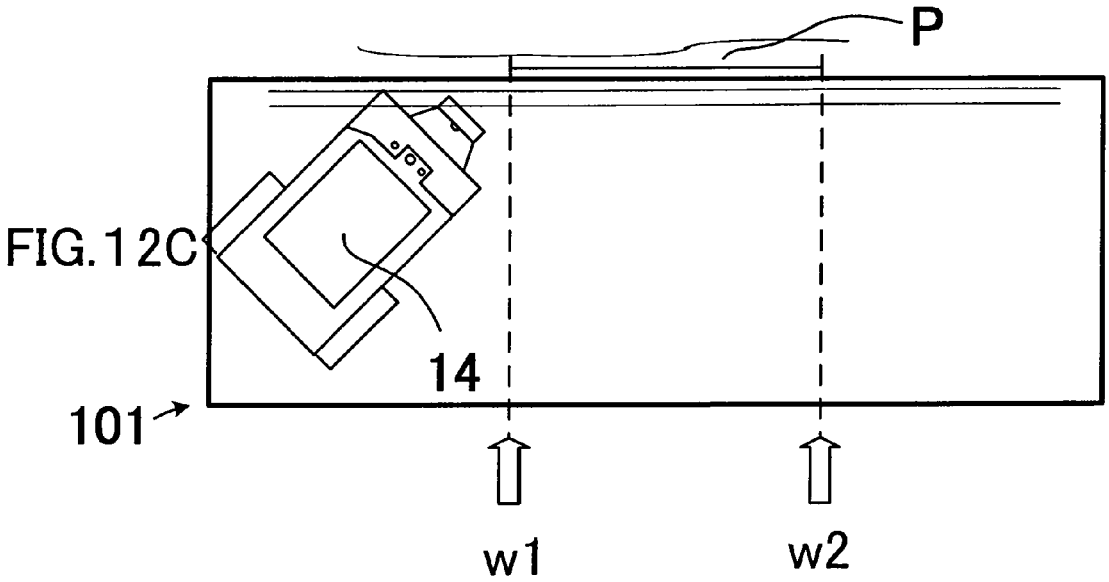

As shown in FIG. 12B, the mechanism 101 starts to move the stapler 14. The mechanism 101 moves the stapler 14 from the left end to the right end in a range of a stroke amount.

The sensor 11 irradiates a light beam on the sheet surface. The sensor 11 receives reflected light from the sheet surface.

The controller 9 scans reflected light intensity along the stapler moving direction. The controller 9 samples the intensity at sampling speed higher than moving speed of the stapler 14.

In Act A7, the controller 9 detects both sheet ends in the sheet width direction of the sheet bundle and calculates stapling positions in two places.

For example, the controller 9 detects the front side sheet end and the rear side sheet end according to a difference in the intensity between adjacent two sampling points.

For example, the controller 9 calculates the positions according to integration of temporal fluctuation in rotating speed of the motor 49. The controller 9 calculates values of sheet ends w1 and w2.

The mechanism 101 stops the stapler 14 in the position E. Alternatively, the mechanism 101 returns the stapler 14 from the right end to the home position B on the left.

Figure 12D:
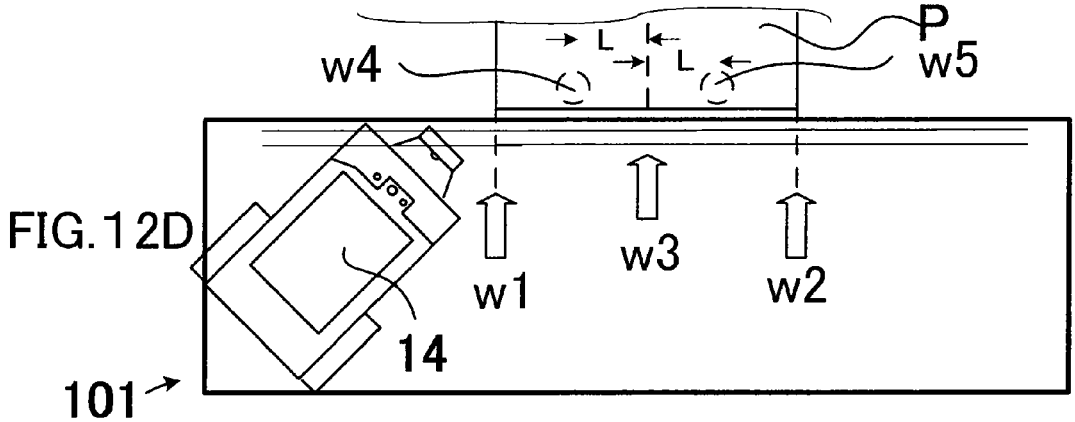

Subsequently, as shown in FIG. 12D, the controller 9 divides a distance between the sheet ends w1 and w2 by 2 to calculate a sheet edge center w3.

The RAM 69*c* stores in advance length L equivalent to a half of a distance between two staples. The controller 9 calculates a distance between places the length L apart from each other symmetrically to the left and right with reference to the sheet edge center w3.

The controller 9 sets, as a first stapling position w4, a position obtained by subtracting the length L from the sheet edge center w3. The controller 9 sets, as a second stapling position w5, a position obtained by adding the length L to the sheet edge center w3.

The controller 9 allocates stapling positions to the first stapling position w4 and the second stapling position w5 with reference to the sheet edge center w3. The controller 9 may adjust the length L.

Figure 12E:
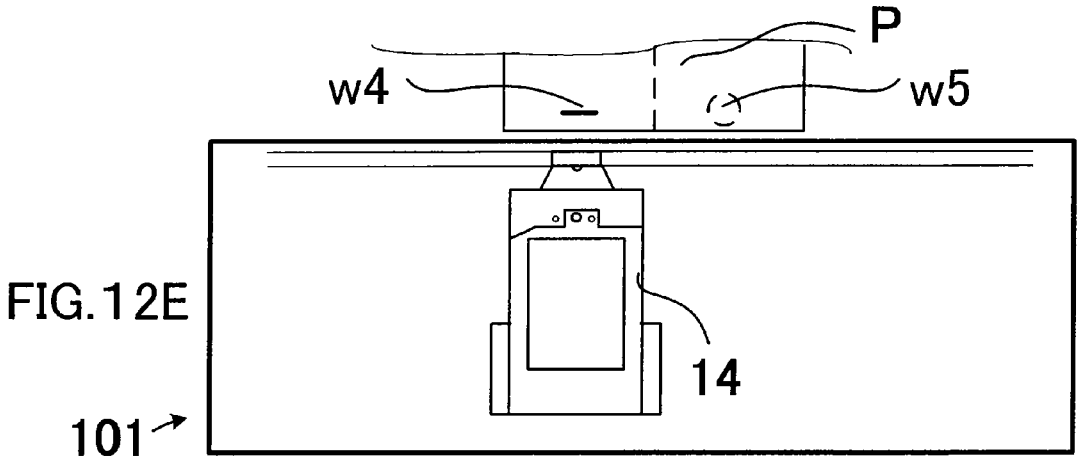

In Act A8, the controller 9 moves the stapler 14 to the first stapling position w4 as shown in FIG. 12E. In the first stapling position w4, the stapler 14 drives a staple into the sheet bundle.

Figure 12F:
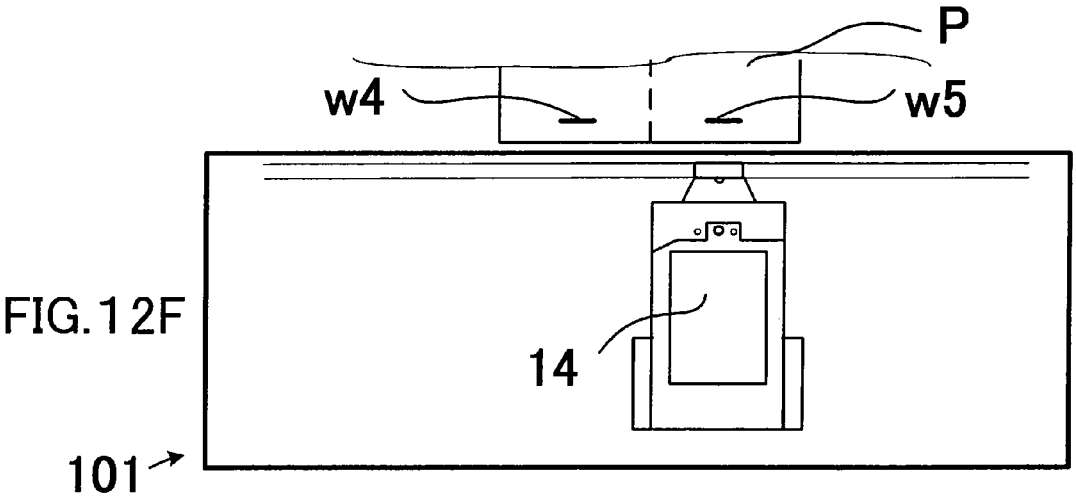

In Act A9, the controller 9 moves the stapler 14 to the second stapling position w5 as shown in FIG. 12F. In the second stapling position w5, the stapler 14 drives a staple into the sheet bundle.

The control of the stapler 14 by the controller 9 ends.

Thereafter, the controller 9 causes the mechanism 101 to return the stapler 14 to the home position B.

In this way, the stapling unit 13 can staple, in two places in the center of a sheet edge, sheets of an unknown size manually inserted by the user.

An example in which the user operates the operation panel 71 to instruct the finisher 7 to staple a sheet corner is explained below.

If the stapling type is stapling of one place on the front side or the rear side in Act A5 (N in Act A5), in Act A10, the controller 9 causes the mechanism 101 to execute scanning in the sheet width direction.

In Act A11, the controller 9 moves the stapler 14 to a sheet corner on the left or the right.

The stapler 14 drives a staple into the rear side sheet end. The stapler 14 rotates the posture of the stapler head. The stapler 14 drives a staple into the sheet bundle in the position E.

Operation in driving a staple into the front side sheet end is the same.

The control of the stapler 14 by the controller 9 ends.

The upper roller 38*a* and the lower roller 38*b* convey the stapled sheet bundle onto the conveyor belt 50 in the first paper discharge tray 16 direction. The pawl 50*a* of the conveyor belt 50 hooks a sheet end on the processing tray 12 side of the sheet bundle.

The pawl 50*a* sends the sheet bundle onto the first paper discharge tray 16. The stapling job ends. The paper discharge roller pair 61 discharges the sheet bundle.

The mechanism 101 of the stapling unit 13 swings the head of the stapler 14. The stapler 14 changes an angle of the tilt of the head.

The mechanism 101 moves to the position B for front side oblique driving and the position E for rear side oblique driving. The mechanism 101 moves to positions C and D for parallel driving. The mechanism 101 moves to the position A for replacement of the stapler 14.

Finishing executed by the finisher 7 on a print job received from the image forming apparatus 5 is explained below. An example in which the stapler 14 staples sheets is explained.

The finisher 7 receives a sheet size and stapling position information from the image forming apparatus 5. The finisher 7 receives print job information from the image forming apparatus 5 with a UART (Universal Asynchronous Receiver/Transmitter) or the like.

The controller 9 moves the pair of alignment plates 47*a* and 47*b* such that the alignment plates 47*a* and 47*b* are located apart from each other on the left and right with respect to the center. The controller 9 receives a command for finishing, sheet size information, and stapling information.

The finisher 7 receives a command for not performing finishing from the image forming apparatus 5. The controller 9 lifts the first paper discharge tray 16. The inlet roller pair 22 and the paper feeding roller pair 24 convey sheets to the waiting tray 10. The waiting tray roller 28 discharges the sheets onto the first paper discharge tray 16.

The finisher 7 receives a command for stapling from the image forming apparatus 5. It is assumed that the processing tray 12 does not have, on the processing tray 12, sheets stapled earlier.

Figure 14:
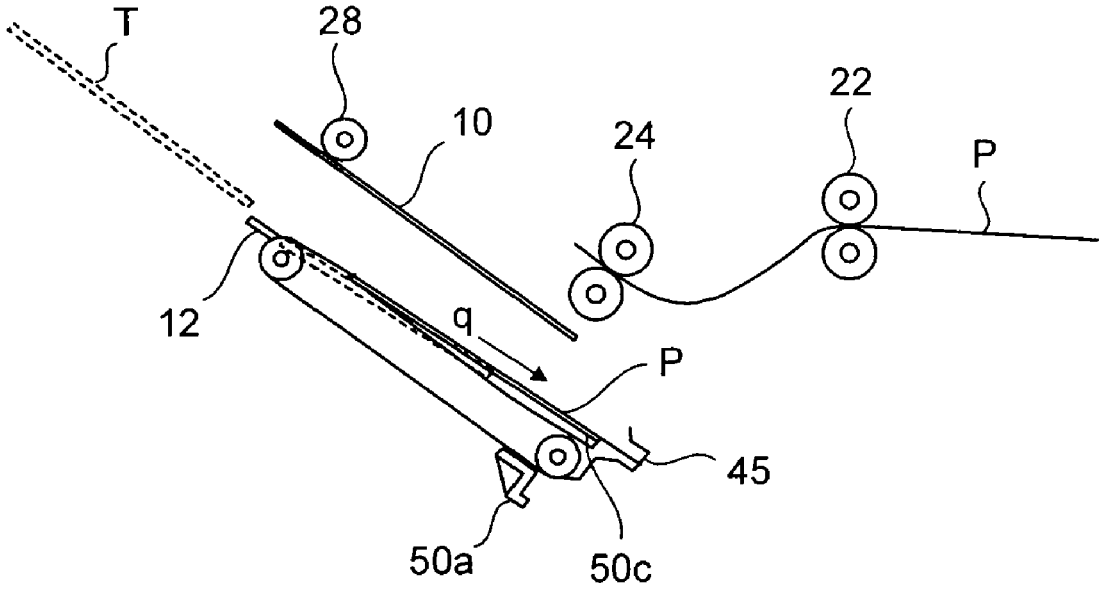
FIG. 14 is a diagram of a conveying path defined in the sheet finishing apparatus.

FIG. 14 is a diagram of a conveying path defined in the finisher 7. The waiting tray 10 drops a sheet onto the processing tray 12.

Prior to the drop of the sheet, the controller 9 retracts the upper roller 38*a* of the alignment roller pair 38 upward. The paddles 44 and the processing tray 12 align the sheet in a longitudinal direction. The longitudinal direction indicates the up to down direction. The alignment plates 47*a* and 47*b* align the sheet in a lateral direction. The lateral direction indicates the depth direction.

The paddles 44 and the like align the sheet in the lateral direction. The alignment plates 47*a* and 47*b* align the sheet in the longitudinal direction. The controller 9 causes the paddles 44 and the like and the alignment plates 47*a* and 47*b* to repeat the alignment of sheet ends.

The controller 9 causes the paper feeding roller pair 24 to continue to feed sheets. The sheets are stacked on the processing tray 12 through the waiting tray 10.

The controller 9 acquires, from the command information, a stapling position of any one of one place on the front side, one place on the rear side, or two places in the center. The controller 9 acquires the sheet size information.

The controller 9 counts up the number of sheets. The number of sheets reaches the number of printed sheets included in the command information. The stapler 14 drives a staple into anyone of the three kinds of stapling positions.

Subsequently, the first paper discharge tray 16 slides from a position indicated by a broken line to a position indicated by a solid line in FIG. 2. The upper roller 38*a* and the lower roller 38*b* nip a sheet bundle and convey the sheet bundle to the first paper discharge tray 16. The pawl 50*a* sends the sheet bundle onto the first paper discharge tray 16. The paper discharge roller pair 61 discharges the sheet bundle.

The finisher 7 receives a command for stapling from the image forming apparatus 5. It is assumed that the processing tray 12 leaves a preceding sheet on the processing tray 12.

The controller 9 waits for the processing tray 12 to be emptied. The controller 9 stacks sheets from the paper feeding roller pair 24 and the image forming apparatus 5 on the waiting tray 10.

The controller 9 detects that the processing tray 12 is empty. The controller 9 causes the waiting tray 10 to drop the sheets onto the processing tray 12.

The paddles 44 and the like align the sheets in the lateral direction. The alignment plates 47*a* and 47*b* align the sheets in the longitudinal direction.

The controller 9 acquires any one of the stapling positions. The controller 9 rotates the motor 49. The controller 9 moves the stapler 14 from the home position to the stapling position.

The stapler 14 drives a staple into any one of the three kinds of stapling positions. The pawl 50*a* of the conveyor belt 50 sends a sheet bundle onto the first paper discharge tray 16. The paper discharge roller pair 61 discharges the sheet bundle.

As explained above, the one stapler 14 can drive staples into two places in parallel in sheets manually inserted by the user.

The stapling unit 13 includes the sensor 11 on a side far from the stapling unit replacement position A.

If the sensor 11 is located at the left end Of the stapler main body width, the stapler 14 needs a large stroke in order to detect the rear side sheet end of sheets.

Since the stapler 14 includes the sensor 11 on a side close to the position E, the sensor 11 can efficiently detect the front side sheet end.

As a first modification, the user may place sheets closer to a tray end on the front side or a tray end on the rear side on the processing tray 12.

For example, a mark may be attached to the tray surface of the processing tray 12. The mark urges the user to set, on the tray surface, the front side sheet end of the sheets on the tray end on the front side.

The mechanism 101 starts movement from the home position B to the right in the stapler moving direction. The sensor 11 detects the rear side sheet end of the sheets by performing sensing.

Since a sheet edge center position is calculated according to one sheet end, moving time of the mechanism 101 can be reduced. The speed of stapling by the stapler 14 can be increased.

As a second modification, after calculating the sheet ends w1 and w2, the controller 9 may move one of the alignment plates 47*a* and 47*b* closer to one sheet end of the sheets. Alternatively, the controller 9 may move the alignment plates 47*a* and 47*b* respectively to both the sheet ends.

Since the alignment plates 47*a* and 47*b* align the sheets again, the finisher 7 is able to align the sheet bundle without imposing a burden of operation on the user.

The finisher 7 is able to effectively use the first stapling position w4 and the second stapling position w5 obtained by calculation. The finisher 7 is able to more neatly align and staple the sheet bundle.

Second Embodiment

A stapling unit according to a second embodiment includes a fixed sensor for detecting a sheet end instead of the movable sensor 11. The stapling unit includes the sensor on the processing tray 12 or in the mechanism 101. A line sensor is used as the fixed sensor for detecting a sheet end.

A sheet finishing apparatus according to this embodiment is also the finisher 7.

The stapling unit according to this embodiment includes the stapler 14, the processing tray 12, and a stapler moving mechanism. The sensor 11 does not need to be provided in the stapler moving mechanism. Other functions of the stapler moving mechanism are substantially the same as the functions of the mechanism 101.

A stapling method according to this embodiment is also the stapling method by the stapler 14.

Figure 15A:
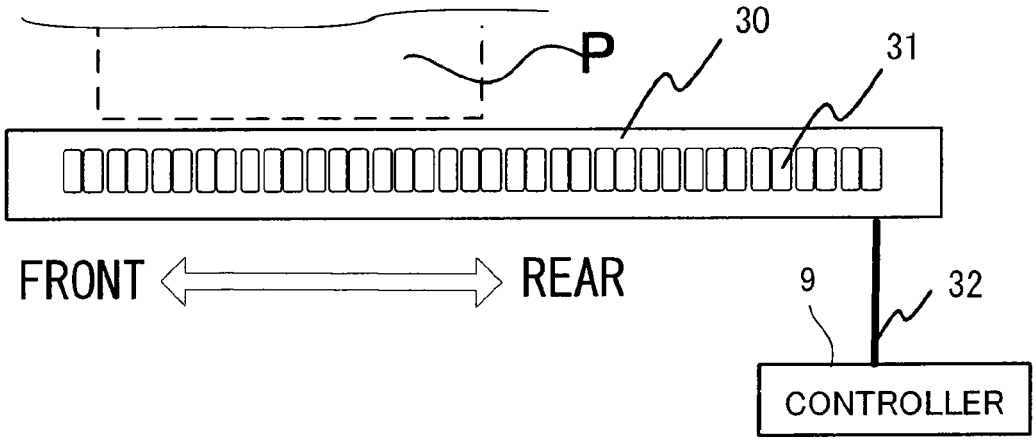
FIG. 15A is a diagram for explaining a stapling method according to a second embodiment.

FIG. 15A is a diagram for explaining the stapling method according to this embodiment. The reference numerals and signs already described above denote the same components. In FIG. 15A, the upper surface of a line sensor is shown.

The finisher 7 includes a line sensor 30 on a tray surface side on which a sheet passes of the two tray surfaces of the processing tray 12.

The line sensor 30 includes plural photodiodes 31. The photodiodes 31 are linearly arranged along the front side and the rear side in the line sensor 30. Light sensing surfaces of the photodiodes 31 are faced upward.

The finisher 7 includes a signal line 32 configured to electrically connect the photodiodes 31 and the controller 9. The controller 9 separately detects outputs of the photodiodes 31.

The length of the line sensor 30 is larger than sheet width of inserted sheets.

Among all the photodiodes 31, the photodiodes 31 not covered by the sheets output electric signals. The photodiodes 31 covered by the sheets do not output electric signals.

The controller 9 detects a sheet end on the front side and a sheet end on the rear side according to the outputs of the photodiodes 31.

The processing tray 12 conveys the sheets above or on the line sensor 30. Thereafter, the controller 9 detects stapling positions in two places in the center of a sheet edge in substantially the same manner as the example in the first embodiment.

The stapler 14 does not need to move in the stapler moving direction to detect a sheet edge center position. The finisher 7 is able to detect the sheet edge center position without moving the stapler 14. The finisher 7 is able to reduce time for detecting the sheet edge center position and realize a substantial increase in speed of stapling of two places.

The line sensor 30 may include the photodiodes 31 at low density.

Figure 15B:
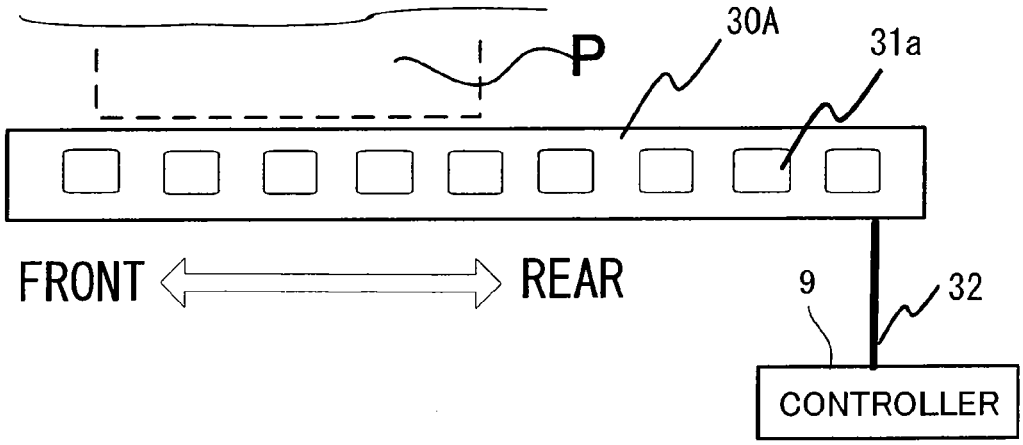
FIG. 15B is a diagram for explaining a stapling method according to a modification of the second embodiment.

FIG. 15B is a diagram for explaining a stapling method according to a modification of this embodiment. The reference numerals and signs already described above denote the same components.

A line sensor 30A includes plural detection elements 31*a*. Each of the detection elements 31*a* includes plural photodiodes. The detection elements 31*a* are linearly arranged along the front side and the rear side in the line sensor 30A. The controller 9 separately detects outputs of the line sensor 30A.

If spaces among the detection elements 31*a* are expanded and the controller 9 monitors the detection elements 31*a* in which ON or OFF reaction occurs during sheet insertion, the number of the detection elements 31*a* can be reduced.

According to the second embodiment, the stapler 14 is able to prevent the size of the mechanism 101 from being increased.

If a moving stroke of the stapler 14 is reduced, the controller 9 can suppress an increase in computational complexity and suppress time required for detection.

Other Embodiments

In the embodiments explained above, the sensor 11 is the light reflection sensor. However a light transmission sensor may be used as the sensor 11.

The attaching position for the sensor 11 explained in the embodiments is only an example. Various positions can be selected.

In the embodiments, the finishing by the finisher is the stapling. It goes without saying that the finisher 7 can also punch a sheet bundle according to a method substantially the same as the method explained above.

In the second embodiment, for example, plural elements configured to detect that a sheet comes into contact with the elements may be provided as the detection elements in the stapler moving direction.

An optical sensor may be provided in the opening 70 of the finisher 7 in order to detect that the user manually inserts sheets in the opening 70.

While certain embodiments have been described, these embodiments have been presented by way of example only, and are not intended to limit the scope of the inventions. Indeed, the novel methods and systems described herein may be embodied in a variety of other forms; furthermore various omissions and substitutions and changes in the form of methods and systems described herein may be made without departing from the sprit of the inventions. The accompanying claims and their equivalents are intended to cover such forms or modifications as would fall within the scope and sprits of the inventions.

What is claimed is:

1. A stapling unit comprising:

a stapler configured to staple sheets in two stapling positions near a center of a sheet edge in a sheet supply direction;

a processing tray configured to sustain a bundle of the sheets inserted by a user to the stapler;

a stapler moving mechanism configured to move the stapler in a sheet width direction orthogonal to the sheet supply direction;

a sensor configured to sense the sheets in the sheet width direction; and a controller configured to measure sheet width of the sheets according to an output of the sensor, allocate the two stapling positions with reference to the output from the sensor, move the stapler moving mechanism to the two stapling positions, and drive the stapler.

2. The unit of claim 1, wherein the sensor is provided in the stapler moving mechanism.

3. The unit of claim 1, wherein the sensor includes plural light detection element groups each linearly fixed in the sheet width direction on the processing tray, and the controller calculates a center position between other two sheet edges each orthogonal to the sheet edge according to outputs of the light detection element groups not covered by the sheets among the plural light detection element groups and outputs of the light detection element groups covered by the sheets.

4. The unit of claim 1, wherein the controller calculates a center position between other two sheet edges each orthogonal to the sheet edge and allocates the two stapling positions with reference to the center position.

5. A sheet finishing apparatus comprising:

a main body having an opening into which a user manually inserts sheets;

a stapler configured to staple sheets in two stapling positions near a center of a sheet edge in a sheet supply direction;

a processing tray configured to sustain a bundle of the sheets inserted by the user from the opening to the stapler;

a stapler moving mechanism configured to move the stapler in a sheet width direction orthogonal to the sheet supply direction from the processing tray to the stapler;

a sensor configured to sense the sheets in the sheet width direction;

a controller configured to measure sheet width of the sheets according to an output of the sensor, allocate the two stapling positions with reference to the output from the sensor, move the stapler moving mechanism to the two stapling positions, and drive the stapler; and a conveying mechanism configured to convey the bundle of the sheets stapled by the stapler according to information concerning the two stapling positions from the processing tray to the opening.

6. The apparatus of claim 5, wherein the sensor is provided in the stapler moving mechanism.

7. The apparatus of claim 5, wherein the stapler moving mechanism includes:

a table provided below the stapler;

a slit provided in the table and configured to guide the stapler in stroke directions each crossing the sheet supply direction; and a supporting member guided by the slit and configured to support the stapler, the slit having a replacement position for the stapler further on an outer side than a home position of the stapler, and the sensor being provided on an opposite side of the replacement position with respect to a center in the sheet width direction of stapler main body width.

8. The apparatus of claim 7, further comprising an panel for instructing the controller to staple the two stapling positions in a center of the sheet edge selected by the user, wherein the operation panel displays information for urging the user to manually move the sheets closer to any one of tray ends in the sheet width direction on the processing tray.

9. The apparatus of claim 7, wherein the sensor includes plural light detection elements groups each linearly fixed in the sheet width direction on the processing tray, and the controller calculates a center position between other two sheet edges each orthogonal to the sheet edge according to outputs of the light detection element groups not covered by the sheets among the plural light detection element groups and outputs of the light detection element groups covered by the sheets.

10. The apparatus of claim 7, wherein the controller notifies an image forming apparatus that the apparatus does not receive a print job.

11. The apparatus of claim 5, further comprising an operation panel for instructing the controller to staple the two stapling positions in a center of the sheet edge selected by the user, wherein the operation panel displays information for urging the user to manually move the sheets closer to any one of tray ends in the sheet width direction on the processing tray.

12. The apparatus of claim 5, further comprising an aligning mechanism configured to align the sheet bundle in the sheet width direction, wherein the controller calculates positions of sheet ends and causes the aligning mechanism to align the sheet bundle to at least one of the positions.

13. The unit of claim 5, wherein the controller calculates a center position between other two sheet edges each orthogonal to the sheet edge and allocates the two stapling positions with reference to the center position.

14. A stapling method, comprising:

aligning, on a processing tray, sheets manually inserted;

moving a sensor configured to sense the sheets and a stapler in a sheet width direction orthogonal to a sheet supply direction and measure sheet width of the sheets;

allocating stapling positions in two places spaced apart from each other with respect to an output from the sensor; and moving the stapler to the stapling positions in the two places of the sheets and stapling the sheets.

15. The method of claim 14, further comprising selecting, prior to aligning the sheets on the processing tray, with an operation panel, a stapling position according to user operation.

16. The method of claim 14, further comprising notifying, prior to the measurement of the sheet width by the sensor, an image forming apparatus that the method does not receive a print job.

17. The method of claim 14, wherein the sensor is provided on an opposite side of a stapler replacement position located further on an outer side than a home position of the stapler with respect to a center in the sheet width direction of a stapler main body, and the sensor scans the sheets.

18. The method of claim 14, further comprising displaying, prior to aligning the sheets on the processing tray, on an operation panel, information for urging a user to manually move the sheets closer to any one of tray ends in the sheet width direction.

19. The method of claim 14, further comprising calculating positions of sheet ends and aligning the sheet bundle to at least one of the positions.

20. The method of claim 14, further comprising calculating, prior to allocating the stapling positions, a center position between other two sheet edges each orthogonal to the sheet edge and allocating the stapling positions with reference to the center position.

* * * * *